US011591813B2

(12) United States Patent
Crosby

(10) Patent No.: US 11,591,813 B2
(45) Date of Patent: Feb. 28, 2023

(54) CONCRETE FORM WITH REMOVABLE SIDEWALL

(71) Applicant: Airlite Plastics Co., Omaha, NE (US)

(72) Inventor: Bradley J. Crosby, Omaha, NE (US)

(73) Assignee: Airlite Plastics Co., Omaha, NE (US)

( * ) Notice: Subject to any disclaimer, the term of this patent is extended or adjusted under 35 U.S.C. 154(b) by 0 days.

(21) Appl. No.: 17/035,038

(22) Filed: Sep. 28, 2020

(65) Prior Publication Data

US 2021/0079671 A1 Mar. 18, 2021

Related U.S. Application Data

(63) Continuation of application No. 15/812,639, filed on Nov. 14, 2017, now Pat. No. 10,787,827.
(Continued)

(51) Int. Cl.
*E04G 17/065* (2006.01)
*E04B 2/86* (2006.01)
(Continued)

(52) U.S. Cl.
CPC ..... *E04G 17/0654* (2013.01); *E04B 2/8635* (2013.01); *E04G 15/04* (2013.01);
(Continued)

(58) Field of Classification Search
CPC ..... E04G 15/04; E04G 11/06; E04G 17/02; E04G 17/04; E04G 17/042; E04G 17/047;
(Continued)

(56) References Cited

U.S. PATENT DOCUMENTS 221,110 A 10/1879 Shellenback et al.
858,933 A 7/1907 White
(Continued)

FOREIGN PATENT DOCUMENTS

AT 10642 B 2/1903
AU 664029 B2 11/1995
(Continued)

OTHER PUBLICATIONS

Portland Cement Association, Prescriptive Design of Exterior Concrete Walls for One- and Two-Family Dwellings (2008), 123 pages.
(Continued)

*Primary Examiner* — Michael Safavi
(74) *Attorney, Agent, or Firm* — Banner & Witcoff, Ltd.

(57) ABSTRACT

A concrete form includes a first sidewall and a second sidewall positioned in parallel and spaced relation to each other and a cross tie having opposed first and second ends, where at least the first sidewall is a removable sidewall removably secured to the first end of the cross tie. The second sidewall is removably secured to the second end of the cross tie and may be a removable sidewall or a non-removable sidewall. The concrete form also includes a spacer positioned between the first sidewall and the first end of the cross tie. The spacer may be removable along with the first sidewall. Concrete forming assemblies and methods may incorporate concrete forms as described herein.

20 Claims, 16 Drawing Sheets

Related U.S. Application Data

(60) Provisional application No. 62/446,183, filed on Jan. 13, 2017, provisional application No. 62/421,657, filed on Nov. 14, 2016.

(51) Int. Cl.
*E04G 15/04* (2006.01)
*E04G 17/02* (2006.01)

(52) U.S. Cl.
CPC ..... *E04G 17/02* (2013.01); *E04G 17/0658* (2013.01); *E04B 2002/8682* (2013.01)

(58) Field of Classification Search
CPC ..... E04G 17/0654; E04G 17/0655; E04G 17/0658; E04G 17/0754; E04B 2/8611; E04B 2002/8682; E04B 2/8635; E04B 2/8647; E04B 2/8617; E04B 2/8623; E04B 2/86; E04B 2/847
USPC .... 249/33, 192; 52/426, 442, 428, 378, 379, 52/562, 565, 568, 508
See application file for complete search history.

(56) References Cited

U.S. PATENT DOCUMENTS 1,665,649 A * 4/1928 Whitescarver ..... E04G 17/0658 249/42
1,694,665 A 12/1928 Parker
1,781,601 A * 11/1930 Rohaut ..... E04G 17/0658 52/367
1,796,973 A 3/1931 Wright
1,836,408 A 12/1931 Sutton
1,895,801 A 1/1933 Keller
1,935,218 A * 11/1933 Umbach ..... E04G 17/0658 29/256
1,983,040 A 12/1934 Lyons
2,073,788 A 3/1937 Garvey et al.
2,177,246 A 10/1939 Ellis
2,201,110 A 5/1940 Makram
2,270,035 A * 1/1942 Colt ..... E04G 17/0658 249/175
2,281,833 A * 5/1942 De Canio ..... E04G 17/0658 249/217
2,292,548 A * 8/1942 Schenk ..... E04G 17/0658 249/215
2,452,463 A 10/1948 Herbert
2,498,276 A 2/1950 Kany
3,255,562 A 6/1966 Altschuler
3,374,917 A 3/1968 Troy
3,383,817 A 5/1968 Gregori
3,422,588 A 1/1969 Stewart, Jr.
3,552,076 A 1/1971 Gregori
3,740,909 A 6/1973 Stinnes
3,751,867 A 8/1973 Layne
3,788,020 A 1/1974 Gregori
3,791,090 A 2/1974 Kniefel
3,835,608 A 9/1974 Johnson
3,895,469 A 7/1975 Kapitan
3,924,376 A 12/1975 Tsurumi
3,936,987 A 2/1976 Calvin
3,959,944 A 6/1976 Oroschakoff
3,968,615 A 7/1976 Ivany
3,992,844 A 11/1976 Gretter
4,021,989 A 5/1977 Hala
4,022,644 A 5/1977 Smith, Jr.
4,031,678 A 6/1977 Schuring
4,034,529 A 7/1977 Lampus
4,041,670 A 8/1977 Kaplan
4,060,952 A 12/1977 Hernandez
4,090,337 A 5/1978 Szekeres
4,107,895 A 8/1978 LeGrady
4,133,156 A 1/1979 Unger
4,147,322 A 4/1979 Dahlstrom
4,185,423 A 1/1980 Gutierrez
4,223,501 A 9/1980 DeLozier
4,226,061 A 10/1980 Day, Jr.
4,229,920 A 10/1980 Lount
4,234,156 A 11/1980 Wepf
4,240,233 A 12/1980 Vercelletto
4,247,073 A 1/1981 Vario
4,263,765 A 4/1981 Maloney
4,320,888 A 3/1982 Oury
4,321,779 A 3/1982 Kratchmer
4,348,847 A 9/1982 Jukes
4,366,657 A 1/1983 Hopman
4,402,167 A 9/1983 Denucci
4,406,103 A 9/1983 Ghali et al.
4,407,102 A 10/1983 Boyack
4,411,118 A 10/1983 Claver
4,433,520 A 2/1984 Maschhoff
4,433,521 A 2/1984 Dietrich
4,433,522 A 2/1984 Yerushalmi
4,438,612 A 3/1984 Bernard et al.
4,439,967 A 4/1984 Dielenberg
4,442,644 A 4/1984 Jukes
4,471,590 A 9/1984 Roberts et al.
4,479,338 A 10/1984 Robertson
4,516,372 A 5/1985 Grutsch
4,551,870 A 11/1985 Presti, Jr.
4,557,093 A 12/1985 Beliveau
4,557,094 A 12/1985 Beliveau
4,571,909 A 2/1986 Berghuis et al.
4,577,447 A 3/1986 Doran
4,598,519 A 7/1986 Reid
4,599,830 A 7/1986 Nawrot
4,604,843 A 8/1986 Ott et al.
4,628,652 A 12/1986 Wefels
4,629,192 A 12/1986 Nichols
4,632,796 A 12/1986 Moulet
4,648,228 A 3/1987 Kiselewski
4,655,014 A 4/1987 Krecke
4,669,234 A 6/1987 Wilnau
4,698,947 A 10/1987 McKay
4,700,523 A 10/1987 Kohara
4,706,429 A 11/1987 Young
4,730,422 A 3/1988 Young
4,731,968 A 3/1988 Obino
4,742,659 A 5/1988 Meilleur
4,750,307 A 6/1988 Slager
4,750,308 A 6/1988 McKay
4,765,109 A 8/1988 Boeshart
4,773,199 A 9/1988 Kohara
4,788,020 A 11/1988 Yampolsky et al.
4,791,767 A 12/1988 Boeshart
4,811,927 A 3/1989 Slonimsky et al.
4,817,353 A 4/1989 Woods et al.
4,825,618 A 5/1989 Blevins
4,835,928 A 6/1989 Scott
4,852,317 A 8/1989 Schiavello et al.
4,860,515 A 8/1989 Browning, Jr.
4,862,660 A 9/1989 Raymond
4,864,792 A 9/1989 Andre et al.
4,866,891 A 9/1989 Young
4,879,855 A 11/1989 Berrenberg
4,883,396 A 11/1989 Shamah et al.
4,884,382 A 12/1989 Horobin
4,885,888 A 12/1989 Young
4,888,931 A 12/1989 Meilleur
4,889,310 A 12/1989 Boeshart
4,894,969 A 1/1990 Horobin
4,901,494 A 2/1990 Miller et al.
4,916,879 A 4/1990 Boeshart
4,936,540 A 6/1990 Boeshart
4,938,449 A 7/1990 Boeshart
4,949,515 A 8/1990 Krecke
4,967,528 A 11/1990 Doran
4,972,646 A 11/1990 Miller et al.
4,974,388 A 12/1990 Fischer
4,976,081 A 12/1990 Litzenberger
4,998,394 A 3/1991 Holzapfel et al.
5,014,480 A 5/1991 Guarriello et al.
5,024,035 A 6/1991 Hanson et al.

(56) References Cited

U.S. PATENT DOCUMENTS 5,060,446 A 10/1991 Beliveau
5,065,561 A * 11/1991 Mason ..... E04B 2/8641 52/309.12
5,086,600 A 2/1992 Holland et al.
5,092,093 A 3/1992 Lu
5,097,644 A 3/1992 Hun
5,099,628 A 3/1992 Noland et al.
5,099,630 A 3/1992 Bolmgren
5,107,648 A 4/1992 Roby
5,117,600 A 6/1992 Yerushalmi
5,122,015 A 6/1992 Shen
5,123,222 A 6/1992 Guarriello et al.
5,140,794 A 8/1992 Miller
5,163,261 A 11/1992 O'Neill
5,174,083 A 12/1992 Mussell
D335,542 S 5/1993 Bird
5,212,842 A 5/1993 Glydon
5,215,490 A 6/1993 Szoradi
D343,426 S 1/1994 Sher
D343,427 S 1/1994 Sher
5,323,578 A 6/1994 Chagnon et al.
5,332,189 A 7/1994 Tseng
5,337,530 A 8/1994 Beames
5,350,256 A 9/1994 Hammer
5,351,455 A 10/1994 Schoonover et al.
5,351,456 A 10/1994 Paine, Jr.
5,390,459 A 2/1995 Mensen
5,428,933 A 7/1995 Philippe
5,454,199 A 10/1995 Blom et al.
5,459,970 A 10/1995 Kim
5,459,971 A 10/1995 Sparkman
5,465,542 A 11/1995 Terry
5,473,850 A 12/1995 Balding
5,491,949 A 2/1996 De Moor
5,497,592 A * 3/1996 Boeshart ..... E04B 2/8647 249/43
D370,503 S 6/1996 Burns
5,535,565 A 7/1996 Majnaric et al.
5,537,797 A * 7/1996 Harkenrider ..... E04G 17/00 249/43
5,553,430 A 9/1996 Majnaric et al.
5,566,518 A 10/1996 Martin et al.
5,566,519 A 10/1996 Almaraz-Miera
5,566,521 A 10/1996 Andrews et al.
5,568,710 A 10/1996 Smith et al.
5,570,552 A 11/1996 Nehring
5,596,855 A 1/1997 Batch
5,598,675 A 2/1997 Pruss
5,608,999 A 3/1997 McNamara et al.
5,611,182 A 3/1997 Spude
5,611,183 A 3/1997 Kim
5,617,693 A 4/1997 Hefner
5,625,989 A * 5/1997 Brubaker ..... E04B 2/54 249/40
5,632,126 A 5/1997 Agsten
5,638,652 A 6/1997 Shinoda et al.
5,649,401 A 7/1997 Harrington, Jr.
5,653,082 A 8/1997 Shinoda et al.
5,657,600 A 8/1997 Mensen
5,657,601 A 8/1997 Bean et al.
5,658,483 A 8/1997 Boeshart
5,678,369 A 10/1997 Ishikawa et al.
5,688,078 A 11/1997 Hammer
5,692,356 A 12/1997 Baxter
5,695,676 A 12/1997 Lee
5,699,640 A 12/1997 Bourgeois et al.
5,701,710 A 12/1997 Tremelling
5,704,180 A 1/1998 Boeck
5,709,060 A 1/1998 Vaughan et al.
5,709,061 A 1/1998 Dietrich
5,735,093 A 4/1998 Grutsch
5,740,648 A 4/1998 Piccone
5,761,874 A 6/1998 Hayakawa
5,768,851 A 6/1998 Nagaoka
5,782,050 A 7/1998 Boeshart
5,802,793 A 9/1998 DeVore, Jr.
5,802,795 A 9/1998 Myers et al.
5,803,669 A 9/1998 Bullard
5,809,723 A 9/1998 Keith et al.
5,809,725 A 9/1998 Cretti
5,809,726 A 9/1998 Spude
5,809,727 A 9/1998 Mensen
5,809,728 A 9/1998 Tremelling
5,818,997 A 10/1998 Fasanella et al.
5,819,489 A 10/1998 McKinney
5,836,126 A 11/1998 Harkenrider et al.
5,839,243 A 11/1998 Martin
5,845,445 A 12/1998 Blackbeard
5,845,449 A 12/1998 Vaughan et al.
5,845,455 A 12/1998 Johnson, III
5,852,907 A 12/1998 Tobin et al.
5,853,314 A 12/1998 Bora
5,857,300 A 1/1999 Gates
5,860,262 A 1/1999 Johnson
5,861,105 A 1/1999 Martineau
5,881,524 A 3/1999 Ellison, Jr.
5,887,401 A 3/1999 Moore, Jr.
5,890,337 A 4/1999 Boeshart
5,893,248 A 4/1999 Beliveau
5,895,188 A 4/1999 Cheng
5,896,714 A 4/1999 Cymbala et al.
5,918,427 A 7/1999 VanderWerf
5,930,958 A 8/1999 Stanley
5,930,970 A 8/1999 De Le fevre
5,937,604 A 8/1999 Bowron
5,945,448 A 8/1999 Ninomiya et al.
5,987,830 A 11/1999 Worley
5,992,114 A 11/1999 Zelinsky et al.
6,000,184 A 12/1999 Fernandes
6,070,380 A 6/2000 Meilleur
6,085,476 A 7/2000 Jantzi et al.
6,112,491 A 9/2000 Keith et al.
6,122,880 A 9/2000 Kolb et al.
6,131,360 A 10/2000 Dalen
6,148,576 A 11/2000 Janopaul, Jr.
6,151,856 A 11/2000 Shimonohara
6,151,857 A 11/2000 Raschke
6,167,671 B1 1/2001 Wilson
6,170,220 B1 1/2001 Moore, Jr.
6,173,937 B1 1/2001 Cottongim
6,176,059 B1 1/2001 Cantarano et al.
6,178,711 B1 1/2001 Laird et al.
6,219,984 B1 4/2001 Piccone
6,224,031 B1 5/2001 Boeshart
6,226,951 B1 5/2001 Azar
6,230,462 B1 * 5/2001 Beliveau ..... E04B 2/8617 52/426
6,231,024 B1 5/2001 Kugimiya et al.
6,231,025 B1 5/2001 Takemura
6,233,897 B1 5/2001 Jurik
6,240,692 B1 6/2001 Yost et al.
6,250,024 B1 6/2001 Sculthorpe et al.
6,250,033 B1 6/2001 Zelinsky
6,252,523 B1 6/2001 Mostrom
6,253,518 B1 7/2001 Azar
6,253,519 B1 7/2001 Daniel
6,253,523 B1 7/2001 McKinnon
6,263,631 B1 7/2001 Nisbett et al.
6,276,104 B1 8/2001 Long, Sr. et al.
6,276,549 B1 8/2001 Fasci et al.
6,279,285 B1 8/2001 Kubica
6,279,287 B1 8/2001 Meadows
6,293,059 B1 9/2001 Goodwin
6,293,067 B1 9/2001 Meendering
6,293,068 B1 9/2001 Harrington, Jr.
6,301,851 B1 10/2001 Matsubara
6,308,484 B1 10/2001 Severino
6,314,694 B1 * 11/2001 Cooper ..... E04B 2/8611 249/190
6,314,697 B1 11/2001 Moore, Jr.
6,318,040 B1 11/2001 Moore, Jr.
6,321,496 B1 11/2001 Martin, Jr.
6,321,497 B1 11/2001 Cormier
6,321,498 B1 11/2001 Trovato et al.

(56) References Cited

U.S. PATENT DOCUMENTS 6,324,804 B1 12/2001 Hoogstraten
6,332,300 B1 12/2001 Wakai
6,336,301 B1 1/2002 Moore, Jr.
6,349,520 B2 2/2002 Kubica
6,352,237 B1 3/2002 Severino
6,360,505 B1 3/2002 Johns
6,363,683 B1 4/2002 Moore, Jr.
6,378,260 B1 4/2002 Williamson et al.
6,378,261 B1 4/2002 Agsten
6,401,413 B1 6/2002 Niemann
6,401,419 B1 6/2002 Beliveau
6,405,505 B1 6/2002 Alberti
6,412,231 B1 7/2002 Palatin
6,438,917 B2 8/2002 Kubica
6,438,918 B2 8/2002 Moore, Jr. et al.
6,474,033 B1 11/2002 Luchini et al.
6,481,178 B2 11/2002 Moore, Jr.
6,519,906 B2 2/2003 Yost et al.
6,526,713 B2 3/2003 Moore, Jr.
6,536,172 B1 3/2003 Amend
6,568,141 B2 5/2003 Kremers
6,574,934 B1 6/2003 Queirel
6,578,333 B1 6/2003 Gagliano
6,609,340 B2 8/2003 Moore, Jr. et al.
6,612,083 B1 9/2003 Richards
6,647,686 B2 11/2003 Dunn et al.
6,665,992 B2 12/2003 Hew
6,668,502 B2 12/2003 Beliveau
6,668,503 B2 12/2003 Beliveau
6,681,539 B2 1/2004 Yost et al.
6,688,066 B1 2/2004 Cottier et al.
6,691,481 B2 2/2004 Schmidt
6,761,007 B2 7/2004 Lancelot, III et al.
6,792,729 B2 * 9/2004 Beliveau ..... E04B 2/8617 52/279
6,820,384 B1 11/2004 Pfeiffer
6,832,456 B1 * 12/2004 Bilowol ..... E04G 17/0651 249/40
6,898,912 B2 5/2005 Bravinski
6,945,506 B2 9/2005 Long, Sr.
6,948,289 B2 9/2005 Bravinski
7,059,577 B1 6/2006 Burgett
7,082,731 B2 8/2006 Patz et al.
7,082,732 B2 * 8/2006 Titishov ..... E04B 2/8617 52/426
7,124,547 B2 10/2006 Bravinski
7,266,931 B2 9/2007 Long, Sr.
7,818,935 B2 10/2010 Velickovic
7,934,693 B2 * 5/2011 Bravinski ..... E04B 2/8647 249/216
8,037,652 B2 10/2011 Marshall et al.
8,348,222 B2 1/2013 Lin
8,495,846 B2 7/2013 Bravinski
8,555,583 B2 10/2013 Ciuperca
8,555,584 B2 10/2013 Ciuperca
8,567,750 B2 10/2013 Amend
8,613,174 B2 12/2013 Garrett
8,635,826 B2 1/2014 Pfeiffer
8,646,236 B2 * 2/2014 Hilliard, Sr. ..... E04B 2/8652 52/309.11
8,756,890 B2 6/2014 Ciuperca
8,887,465 B2 11/2014 Crosby et al.
8,919,067 B2 12/2014 Crosby et al.
8,959,862 B1 2/2015 Kreizinger
9,074,379 B2 7/2015 Ciuperca
9,115,491 B2 8/2015 Keith et al.
9,157,233 B2 * 10/2015 Gosain ..... E04B 2/8647
9,458,637 B2 10/2016 Ciuperca
2003/0168575 A1 9/2003 Fearn et al.
2004/0055237 A1 3/2004 Bravinski
2004/0103609 A1 * 6/2004 Wostal ..... E04B 2/8617 52/426
2005/0204679 A1 9/2005 Pfeiffer
2005/0223669 A1 10/2005 Cymbala et al.
2006/0010831 A1 1/2006 Skakie
2006/0117693 A1 6/2006 Garrett
2006/0213140 A1 9/2006 Morin et al.
2009/0057530 A1 3/2009 Sheckter et al.
2009/0120027 A1 5/2009 Amend
2009/0179135 A1 7/2009 Amend
2009/0308011 A1 12/2009 Philippe
2011/0057090 A1 * 3/2011 Spude ..... E04G 11/14 249/19
2012/0131870 A1 5/2012 deMaere
2013/0014458 A1 1/2013 Boydstun, IV et al.
2013/0180192 A1 * 7/2013 Crosby ..... E04B 2/8635 52/309.12
2013/0192156 A1 * 8/2013 Tims ..... E04B 2/26 52/404.2
2014/0308509 A1 10/2014 Gaddes et al.
2014/0319316 A1 10/2014 Bergman
2014/0333010 A1 11/2014 Ciuperca
2015/0135633 A1 * 5/2015 Ciuperca ..... F16B 5/065 52/741.1
2015/0167295 A1 6/2015 Baader
2017/0016237 A1 * 1/2017 Bombardier ..... E04G 11/08
2019/0257088 A1 8/2019 Ciuperca
2020/0063451 A1 2/2020 Amend

FOREIGN PATENT DOCUMENTS

AU 685614 C 12/2001
CA 256091 A 12/1925
CA 443900 A 9/1947
CA 2028992 C 4/1996
CA 2182055 C 5/1999
CA 2256261 A1 6/2000
CA 2257085 A1 6/2000
CA 2142517 C 4/2002
CA 2224949 C 8/2002
CA 2298435 C 11/2002
CA 2500682 C 9/2008
CA 2732490 A1 11/2011
CA 2492969 C 12/2012
CA 2980955 A1 10/2016
CA 2956649 A1 7/2017
CA 2956649 A1 * 7/2017 ..... E04G 17/14
CA 2985438 A1 5/2018
CH 193556 A * 10/1937 ..... E04G 17/0658
CN 2142861 Y 9/1993
CN 2177759 Y 9/1994
CN 2213769 Y 11/1995
CN 2219338 Y 2/1996
CN 2232465 Y 8/1996
CN 2264219 Y 10/1997
CN 2265413 Y 10/1997
CN 2277430 Y 4/1998
CN 2291457 Y 9/1998
CN 2307851 Y 2/1999
CN 2315178 Y 4/1999
CN 2318290 Y 5/1999
CN 2326651 Y 6/1999
CN 2329720 Y 7/1999
CN 2330727 Y 7/1999
CN 2346856 Y 11/1999
CN 2360486 Y 1/2000
CN 1075183 C 11/2001
CN 1113283 C 7/2003
CN 1174922 C 11/2004
CN 1177390 C 11/2004
CN 1230237 C 12/2005
DE 2111730 A1 * 12/1972 ..... E04B 2/8611
DE 2111730 A1 12/1972
DE 2229113 A1 1/1974
DE 2255810 A1 5/1974
DE 3233470 A1 3/1984
DE 3315942 A1 11/1984
DE 3609780 A1 10/1986
DE 3609780 A1 * 10/1986 ..... E04B 2/8611
DE 4415406 A1 11/1995
DE 4434057 A1 3/1996
DE 29603330 U1 4/1996

(56) References Cited

FOREIGN PATENT DOCUMENTS

| | | | | | |
|---|---|---|---|---|---|
| DE | 29605098 | U1 | | 8/1996 | |
| DE | 19516134 | A1 | | 11/1996 | |
| DE | 19520082 | A1 | | 12/1996 | |
| DE | 29702609 | U1 | | 4/1997 | |
| DE | 29711257 | U1 | | 8/1997 | |
| DE | 102007005351 | A1 | | 8/2008 | |
| DE | 102012205470 | A1 | | 6/2012 | |
| DE | 102014104722 | A1 | | 10/2015 | |
| DE | 202015105866 | U1 | | 1/2016 | |
| EP | 540478 | | * | 5/1993 | ..... E04B 2002/8682 |
| EP | 540478 | A1 | | 5/1993 | |
| EP | 1036891 | A1 | | 9/2000 | |
| EP | 1749951 | A1 | | 2/2007 | |
| EP | 2789759 | A1 | | 10/2014 | |
| EP | 2886745 | A1 | * | 6/2015 | ..... E04G 17/0658 |
| EP | 2927383 | A1 | | 10/2015 | |
| FR | 2328814 | A1 | | 5/1977 | |
| FR | 2394647 | A1 | | 1/1979 | |
| FR | 2570416 | A1 | | 3/1986 | |
| FR | 3006700 | A1 | | 12/2014 | |
| FR | 3006701 | A1 | | 12/2014 | |
| FR | 3019198 | A1 | | 10/2015 | |
| GB | 190013282 | A | | 5/1901 | |
| GB | 113039 | A | * | 2/1918 | ..... E04B 2/8641 |
| GB | 113039 | A | | 2/1918 | |
| GB | 157638 | A | | 1/1921 | |
| GB | 162104 | A | | 4/1921 | |
| GB | 189481 | A | | 11/1922 | |
| GB | 296834 | A | | 9/1928 | |
| GB | 442286 | A | | 1/1936 | |
| GB | 442223 | A | | 2/1936 | |
| GB | 488640 | A | | 7/1938 | |
| GB | 508283 | A | | 6/1939 | |
| GB | 516873 | A | | 1/1940 | |
| GB | 517915 | A | | 2/1940 | |
| GB | 552692 | A | | 4/1943 | |
| GB | 600513 | A | | 4/1948 | |
| GB | 1385045 | A | | 2/1975 | |
| GB | 2162221 | A | | 1/1986 | |
| GB | 2170258 | A | | 7/1986 | |
| GB | 2240121 | A | | 7/1991 | |
| KR | 20150145534 | A | * | 12/2015 | ..... E04G 17/0658 |
| WO | 9512720 | A1 | | 5/1995 | |
| WO | 9905370 | A1 | | 2/1999 | |
| WO | 0233184 | A2 | | 4/2002 | |
| WO | 2011123526 | A2 | | 10/2011 | |
| WO | 2014138841 | A1 | | 9/2014 | |
| WO | 2016200131 | A1 | | 12/2016 | |
| WO | 2017171111 | A1 | | 10/2017 | |
| ZA | 9702802 | B | | 10/1998 | |

OTHER PUBLICATIONS

NAHB Research Center, Inc., "Prescriptive Method for Insulating Concrete Forms in Residential Construction," May 1998, 100 pages.

NAHB Research Center, Inc., "Prescriptive Method for Insulating Concrete Forms in Residential Construction," Second Edition, Jan. 2002, 62 pages.

Pieter A. VanderWerf et al., Insulating Concrete Forms for Residential Design and Construction (McGraw-Hill 1997).

IntegraSpec "The User Friendly ICF" IntegraECF (Exposed Concrete Face), http://www.integraspec.com/documents/IntegraExposed2.pdf, Dec. 4, 2017.

One Sided Forms Against Shoring Wall, http://www.contractortalk.com/f84/one-sided-forms-against-shoring-wall-183250/index2/, Dec. 5, 2017.

Concrete Form Plywood, http://www.greatnorthernlumber.com/gnl/?page_id=978, Dec. 5, 2017.

High Density Overlay (HDO) Plyform, https://www.performancepanels.com/hdo-high-density-overlay-plyform, Dec. 5, 2017.

New Silk Concrete Wall, http://www.scottmagic.net/new-salk-concrete-wall, Dec. 5, 2017.

Form Work, http://www.free-ed.net/free-ed/Resources/Trades/carpentry/Building01/default.asp?iNum=0601, Dec. 5, 2017.

* cited by examiner

CONCRETE FORM WITH REMOVABLE SIDEWALL

CROSS-REFERENCE TO RELATED APPLICATIONS

This application is a continuation of co-pending U.S. patent application Ser. No. 15/812,639, filed Nov. 14, 2016, which is a non-provisional of, and claims priority to, U.S. Provisional Application No. 62/421,657, filed Nov. 14, 2016, and U.S. Provisional Application No. 62/446,183, filed Jan. 13, 2017, and this application claims priority to and the benefit of all of these prior applications, which are incorporated herein their entireties.

FIELD OF THE INVENTION

This disclosure relates to concrete forms, concrete forming assemblies, and methods of forming concrete structures, and more specifically to concrete forms with at least one removable sidewall, as well as concrete forming assemblies and methods utilizing such concrete forms.

BACKGROUND

Insulated concrete forms (ICFs) are often used in the construction of concrete walls and other structures. ICFs typically include a pair of spaced sidewalls fabricated of an insulating material such as expanded polystyrene foam. The sidewalls are connected to each other by cross ties. The cross ties span between the sidewalls and maintain the sidewalls in spaced relationship to define a cavity in between the sidewalls. ICFs are adapted to receive poured concrete in the cavity between the sidewalls. ICFs typically come in modular sizes and are configured to be stacked to create a forming assembly for a concrete wall. The sidewalls are typically left in place after the concrete cures, thereby resulting in a concrete wall intermediate insulating sidewalls. An example of an ICF wall structure is depicted in U.S. Pat. No. 7,861,479 and example ICF products sold under the brand FOX BLOCKS® are shown and described at www.fox-blocks.com. ICFs typically do not permit removal of either of the sidewalls to expose the surface of the concrete after the concrete structure has been formed. Accordingly, while certain existing concrete forms have a number of advantageous features, they nevertheless have certain limitations. The present disclosure seeks to overcome certain of these limitations and other drawbacks of the prior art, and to provide new features not heretofore available.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

In general, aspects of the disclosure relate to concrete forms that have at least one removable sidewall, as well as concrete forming assemblies incorporating such concrete forms and methods incorporating such concrete forms and forming assemblies. Such concrete forms may generally include two sidewalls that are spaced by at least one, and typically multiple, cross ties that have the sidewalls removably or non-removably connected at opposite ends thereof. The concrete forms may be provided as prefabricated concrete forms in some configurations.

According to one aspect, a removable sidewall may be a non-insulating sidewall formed from a non-insulating material such as wood (e.g., plywood or fiberboard) or thermoplastic sheet.

According to another aspect, a non-removable sidewall may be an insulating sidewall formed of an insulating material, such as expanded polystyrene foam.

According to a further aspect, any of the concrete forms described herein, or the assemblies and methods incorporating such concrete forms, may include features and aspects of any other embodiments described herein.

Aspects of the disclosure relate to a concrete form that includes a first sidewall and a second sidewall positioned in parallel and spaced relation to each other and a cross tie having opposed first and second ends, where the first sidewall is removably secured to the first end of the cross tie and the second sidewall is removably secured to the second end of the cross tie. The concrete form also includes a first spacer positioned between the first sidewall and the first end of the cross tie such that the first sidewall does not contact the cross tie and a second spacer positioned between the second sidewall and the second end of the cross tie such that the second sidewall does not contact the cross tie.

Additional aspects of the disclosure relate to a concrete form that includes a first sidewall and a second sidewall positioned in parallel and spaced relation to each other and a cross tie having opposed first and second ends, where the first sidewall is removably secured to the first end of the cross tie and the second sidewall is secured to the second end of the cross tie. A spacer is positioned between the first sidewall and the first end of the cross tie to define a space between the first sidewall and the cross tie such that the first sidewall does not contact the cross tie and concrete can fill the space during concrete fabrication. The spacer is connected to the first sidewall, and the spacer is formed separately from the cross tie and is removably connected to the cross tie to permit removal of the spacer after the concrete fabrication. The spacer may also be removably connected to the first sidewall.

Additional aspects of the disclosure relate to a concrete form that includes a first sidewall and a second sidewall positioned in parallel and spaced relation to each other and a cross tie having opposed first and second ends, where the first sidewall is removably secured to the first end of the cross tie and the second sidewall is secured to the second end of the cross tie. A spacer is positioned between the first sidewall and the first end of the cross tie to define a space between the first sidewall and the cross tie. A fastener is connected to the first sidewall, the spacer, and the cross tie to removably secure the spacer and the first sidewall to the cross tie. The spacer may also be removably connected to the first sidewall by the fastener.

Additional aspects of the disclosure relate to a concrete form that includes a first sidewall and a second sidewall positioned in parallel and spaced relation to each other and a cross tie having opposed first and second ends, where the first sidewall is removably secured to the first end of the cross tie and the second sidewall is secured to the second end of the cross tie. A spacer is positioned between the first sidewall and the first end of the cross tie to define a space between the first sidewall and the cross tie, and the spacer is connected to the first sidewall and removably connected to the first end of the cross tie. The spacer has a width that is smaller proximate the first end of the cross tie and larger proximate the first sidewall to assist in removal of the spacer from the resultant concrete structure if desired. According to one aspect, the spacer may include a spacer body having a first side and a second side opposite the first side, where the first side abuts the first sidewall and the second side abuts the first end of the cross tie, and the width of the spacer is smaller at the second side and larger at the first side. The width of the spacer body may taper continuously from the first side to the second side, e.g., if the spacer body has a frusto-conical shape. According to another aspect, the spacer further includes a dowel portion projecting outwardly from the first side of the spacer body and being received in a hole in the first sidewall.

Additional aspects of the disclosure relate to a concrete form that includes a first sidewall and a second sidewall positioned in parallel and spaced relation to each other and a cross tie having opposed first and second ends, where the first sidewall is removably secured to the first end of the cross tie and the second sidewall is secured to the second end of the cross tie. A spacer is positioned between the first sidewall and the first end of the cross tie to define a space between the first sidewall and the cross tie, and the spacer is connected to the first sidewall and removably connected to the first end of the cross tie. The spacer includes a spacer body having a first side and a dowel portion projecting outwardly from the first side and received in a hole in the first sidewall, where the first side is wider than the dowel portion and abuts an inner surface of the first sidewall proximate the hole.

Additional aspects of the disclosure relate to a concrete form that includes a removable sidewall having a first thickness and an inner surface and an insulating sidewall positioned in parallel and spaced relation to the removable sidewall and having an inner surface facing the inner surface of the removable sidewall, the insulating sidewall having a second thickness that is greater than the first thickness. The concrete form also includes a cross tie having opposed first and second ends, where the removable sidewall is removably secured to the first end of the cross tie and the insulating sidewall is secured to the second end of the cross tie. The insulating sidewall has complementary mating teeth and recesses on top and bottom surfaces thereof for stacking, and the removable sidewall is dimensioned so that the first thickness is no larger than a distance defined between the teeth and the inner surface of the insulating sidewall.

Further aspects of the disclosure relate to a concrete forming assembly that includes a first concrete form having a first sidewall, a second sidewall, and a first cross tie, where the first sidewall is secured to a first end of the first cross tie and the second sidewall is secured to a second end of the first cross tie, such that a first space is defined between the first and second sidewalls. The first and second sidewalls each have an inner surface facing the first space, and the first sidewall is an insulating sidewall having a first thickness. The assembly also includes a second concrete form having a third sidewall, a fourth sidewall, and a second cross tie, where the third sidewall is removably secured to a first end of the second cross tie and the fourth sidewall is secured to a second end of the second cross tie, such that a second space is defined between the third and fourth sidewalls. The third and fourth sidewalls each have inner surfaces facing the second space, and the third sidewall is a removable sidewall having a second thickness that is smaller than the first thickness of the first sidewall. The second concrete form is configured to be stacked on top of the first concrete form such that the third sidewall is stacked on top of the first sidewall and the fourth sidewall is stacked on top of the second sidewall. In this stacked configuration, the inner surfaces of the first sidewall and the third sidewall are flush with each other, and the inner surfaces of the second and fourth sidewalls are flush with each other. According to one aspect, the first sidewall includes complementary mating teeth and recesses on top and bottom surfaces thereof for stacking, and the second thickness of the third sidewall is dimensioned so that the third sidewall is configured to fit between the teeth and the inner surface of the first sidewall. For example, the second thickness of the third sidewall may be less than or equal to the distance between the teeth and the inner surface of the first sidewall. The third sidewall may abut the side surfaces of the teeth in one configuration.

Further aspects of the disclosure relate to a concrete forming assembly that includes a plurality of concrete forms stacked on top of each other to form a vertical stacked configuration, where each concrete form has two sidewalls and a cross tie, such that the two sidewalls are spaced from each other to define a space therebetween. The sidewalls of the concrete forms each have an inner surface facing the space, and the cross tie extends across the space between the two sidewalls, such that the two sidewalls are connected to opposed ends of the cross tie. The sidewalls of the plurality of concrete forms include both insulating sidewalls connected to the cross ties and removable sidewalls removably connected to the cross ties, where the removable sidewalls have thicknesses that are smaller than thicknesses of the insulating sidewalls. At least one insulating side wall and at least one removable sidewall are stacked on top of each other in the assembly, and the plurality of concrete forms are configured such that the inner surfaces of all sidewalls stacked on top of each other are flush with each other.

Other aspects of the disclosure relate to a method for use with a concrete forming assembly that may be provided including a first concrete form having two sidewalls spaced by a first cross tie and a second concrete form stacked on top of the first concrete form and having two sidewalls spaced by a second cross tie, with the sidewalls of the first concrete form including an insulating sidewall and the sidewalls of the second concrete form including a removable sidewall. The removable sidewall of the second concrete form is stacked on top of the insulating sidewall of the first concrete form, such that the concrete forming assembly defines a continuous cavity with inner surfaces of the sidewalls of the first and second concrete forms facing the continuous cavity, and the inner surfaces of the removable sidewall and the insulating sidewall are flush with each other. The method further includes forming a concrete structure within the continuous cavity by introducing concrete into the continuous cavity and allowing the concrete to solidify, and then removing the removable sidewall after the concrete has solidified to expose an exterior surface of the concrete structure.

Other aspects of the disclosure relate to a method for use with a concrete forming assembly that may be provided including a first concrete form having a first sidewall and a second sidewall positioned in parallel and spaced relation to each other to define a cavity, with inner surfaces of the first and second sidewalls facing the cavity, and a cross tie having opposed first and second ends, where the first sidewall is removably secured to the first end of the cross tie and the second sidewall is secured to the second end of the cross tie. The first concrete form also has a spacer positioned between the first sidewall and the first end of the cross tie to define a space between the first sidewall and the cross tie, and the spacer is connected to the first sidewall and removably connected to the cross tie. The method further includes forming a concrete structure within the cavity by introducing concrete into the cavity and allowing the concrete to solidify, and then removing the first sidewall and the spacer after the concrete has solidified to expose an exterior surface of the concrete structure. The spacer is connected to the first sidewall such that the first sidewall and the spacer are removed as a single unit.

Other features and advantages of the disclosure will be apparent from the following description taken in conjunction with the attached drawings.

BRIEF DESCRIPTION OF THE DRAWINGS

Further details, aspects, and embodiments of the concrete form of the present disclosure are apparent, by way of example, with reference to the drawings.

DETAILED DESCRIPTION

Figure 1:
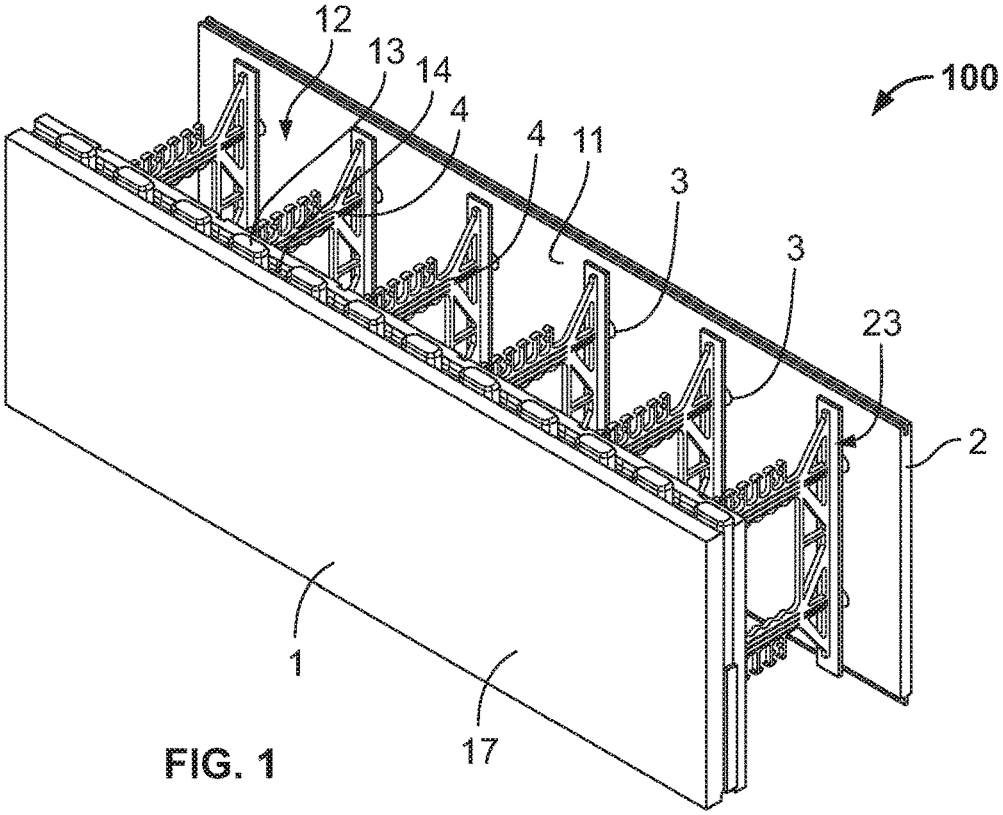
FIG. 1 is a top left perspective view of one embodiment of a concrete form having a single removable sidewall according to aspects of the present disclosure.

While this invention is susceptible of embodiment in many different forms, there are shown in the drawings, and will herein be described in detail, preferred embodiments of the invention with the understanding that the present disclosure is to be considered as an exemplification of the principles of the invention and is not intended to limit the broad aspects of the invention to the embodiments illustrated and described.

The present disclosure relates to concrete forms, concrete forming assemblies constructed using such concrete forms, and methods of assembling concrete forming assemblies and forming concrete walls or other structures using such forms and assemblies. It is understood that while the structures and methods are described herein for forming concrete structures, these structures and methods may be used for forming structures using different materials that can be introduced in a flowable form for later solidification. In general, the concrete forms of the present disclosure have sidewalls that are spaced by one or more cross ties, where at least one of the sidewalls is readily and efficiently removable to expose the exterior surface of the cured/solidified concrete wall within the forms. FIGS. 1-21 depict examples of concrete forms, assemblies, and components thereof, and FIGS. 22-25 depict an examples of methods for forming concrete structures that may use such forms, assemblies, and/or components, according to embodiments of the present disclosure. The concrete forms of the present disclosure can be provided as prefabricated forms, such that the individual forms arrive assembled at the job site and/or are made available for sale already assembled. It is understood that connections described or claimed that are not specified as being removable or non-removable may be either removable or non-removable.

Figure 19:
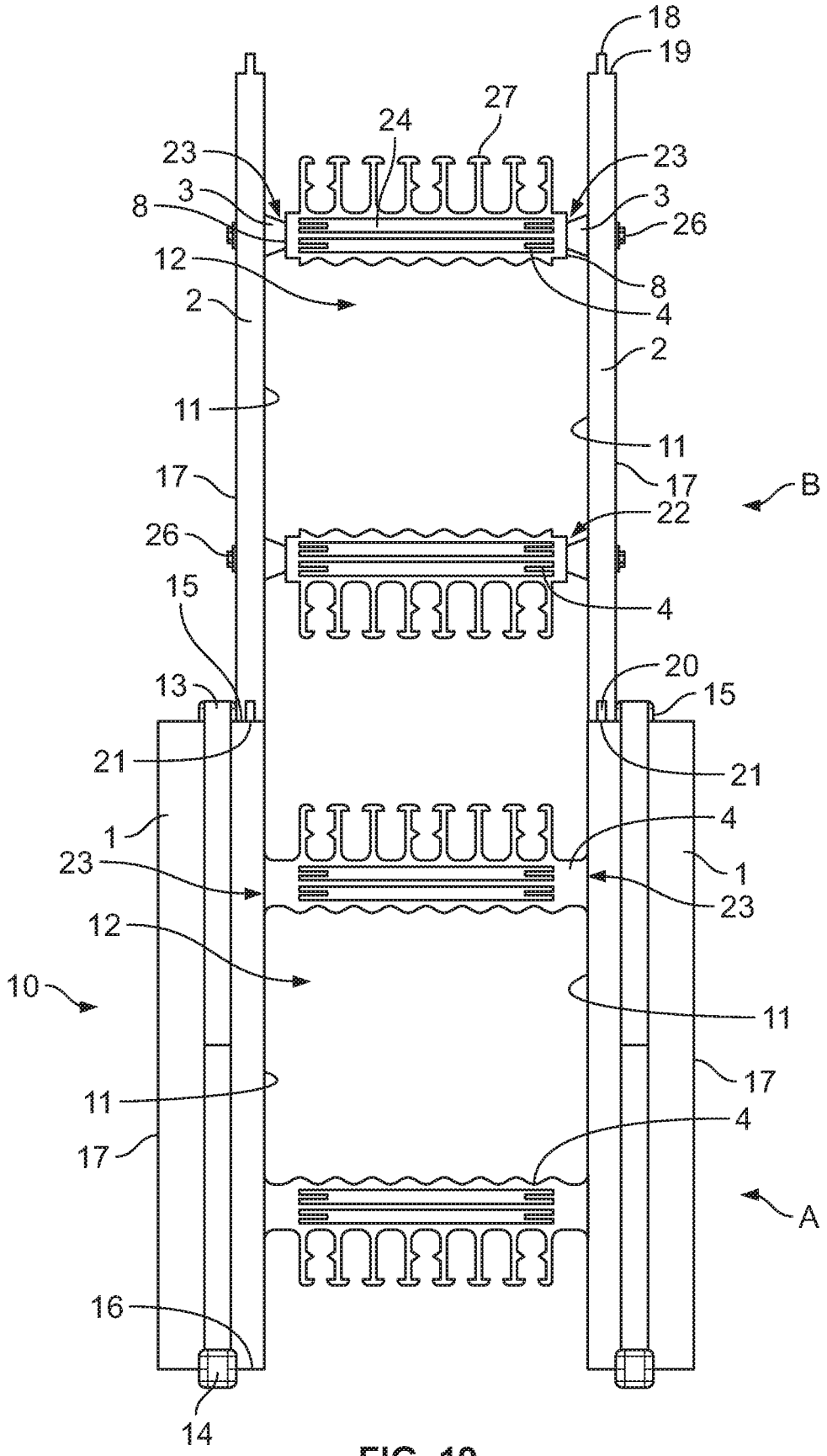
FIG. 19 is a front view of one embodiment of a concrete forming assembly having two concrete forms stacked upon each other according to aspects of the present disclosure.
Figure 20:
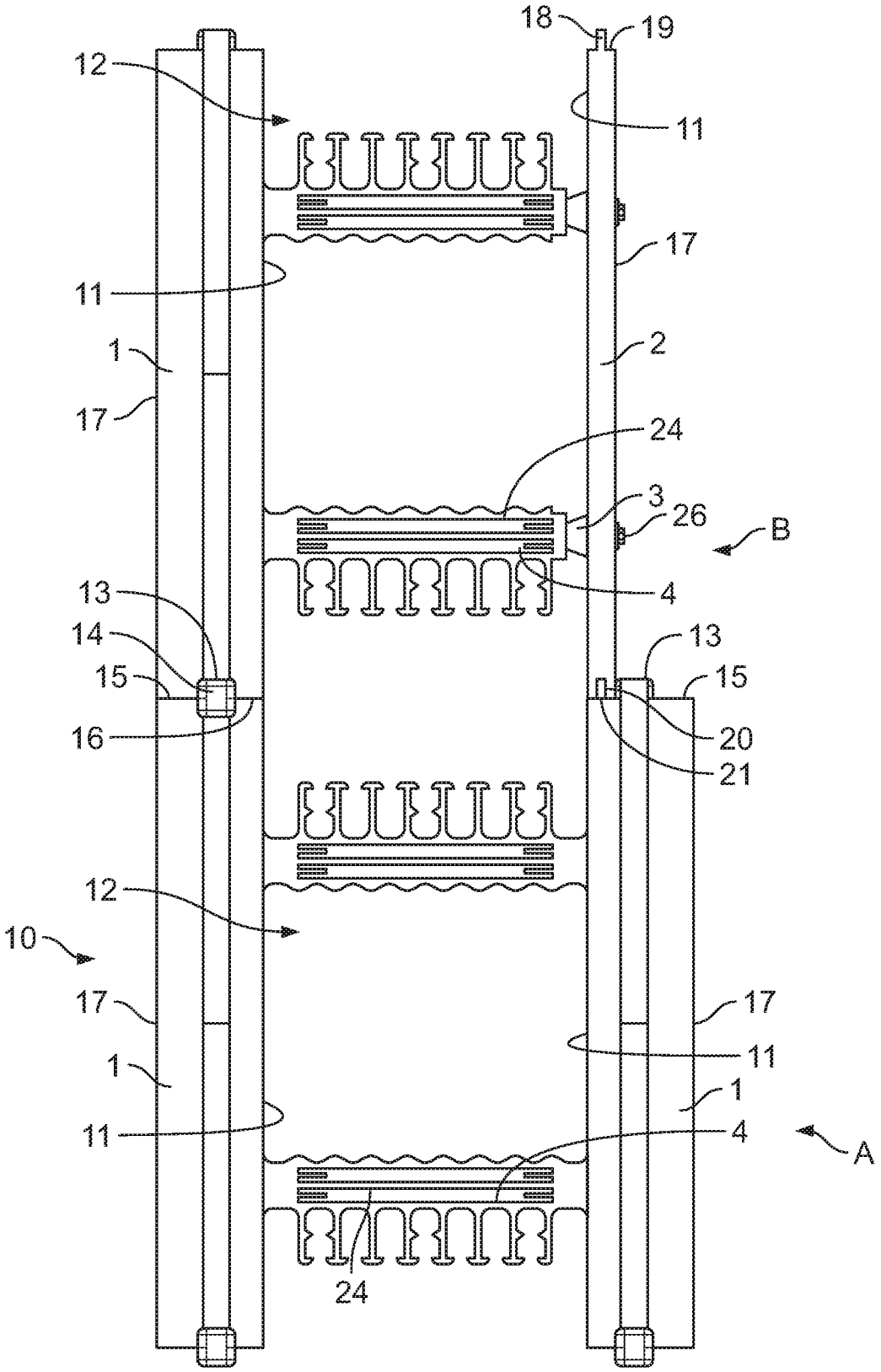
FIG. 20 is a front view of another embodiment of a concrete forming assembly having two concrete forms stacked upon each other according to aspects of the present disclosure.
Figure 21:
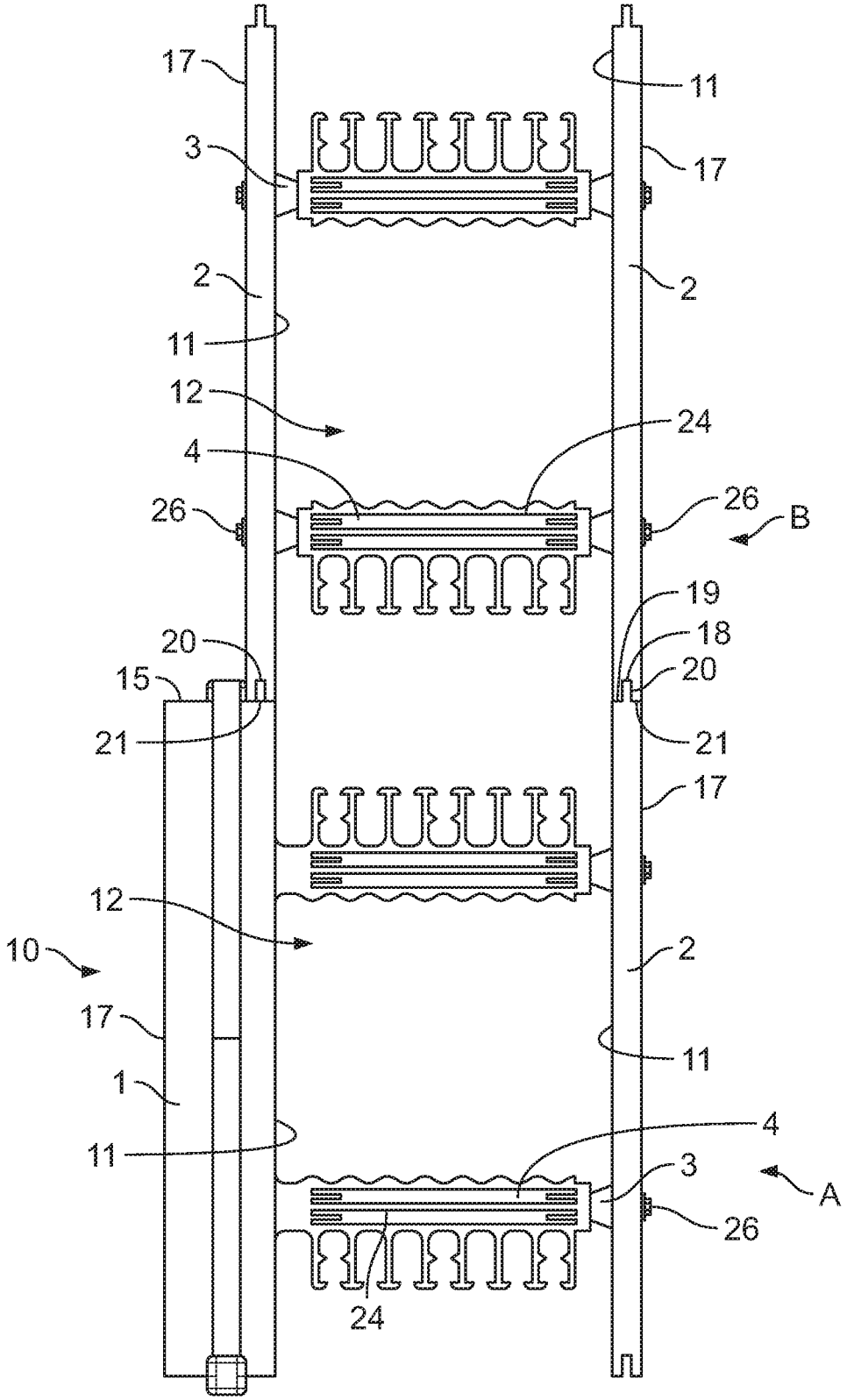
FIG. 21 is a front view of another embodiment of a concrete forming assembly having two concrete forms stacked upon each other according to aspects of the present disclosure.

In one embodiment shown in FIGS. 1-6, a concrete form 100 includes two sidewalls 1, 2 that are spaced from each other and are separated by a plurality of cross ties 4. The sidewalls 1, 2 are connected to the ends 23 of the cross ties 4. The sidewalls 1, 2 of the concrete form 100 in FIGS. 1-4 include an insulating sidewall 1 constructed of insulating material, which is designed to stay in place as insulation for the resulting concrete structure, and a removable sidewall 2, which is designed to be easily and efficiently removed to expose the surface of the cured/solidified concrete structure. The insulating sidewall 1 can be constructed of expanded polystyrene foam (EPS) or other insulating material, and the removable sidewall 2 can be construed of a non-EPS material, e.g. thermoplastic sheet or a wood material (including solid wood, plywood, fiberboard, etc.) in various embodiments. In some embodiments, the insulating sidewall 1 may be configured as a "permanent" sidewall that is not removable from the cross tie(s) 4 without damage to one or both components. Generally, the insulating sidewall 1 is intended to remain in place after forming of the concrete structure. In other embodiments, concrete forms 100 according to this disclosure may have a different type of permanent or non-removable sidewall that may not be considered to be "insulating," yet which may be connected to one or more cross ties 4 in a similar manner as the insulating sidewalls 1 described herein, and/or the insulating sidewall 1 may be configured with a structure that is removable but is still intended to optionally remain in place after concrete formation. FIGS. 20-21 illustrate another embodiment of a concrete form 100 with one insulating sidewall 1 and one removable sidewall 2. In other embodiments, a concrete form 100 may be constructed using two removable sidewalls 2, such as shown in FIGS. 10-14, 19, and 21, or two insulating sidewalls 1, as shown in FIGS. 19-20.

Figure 2:
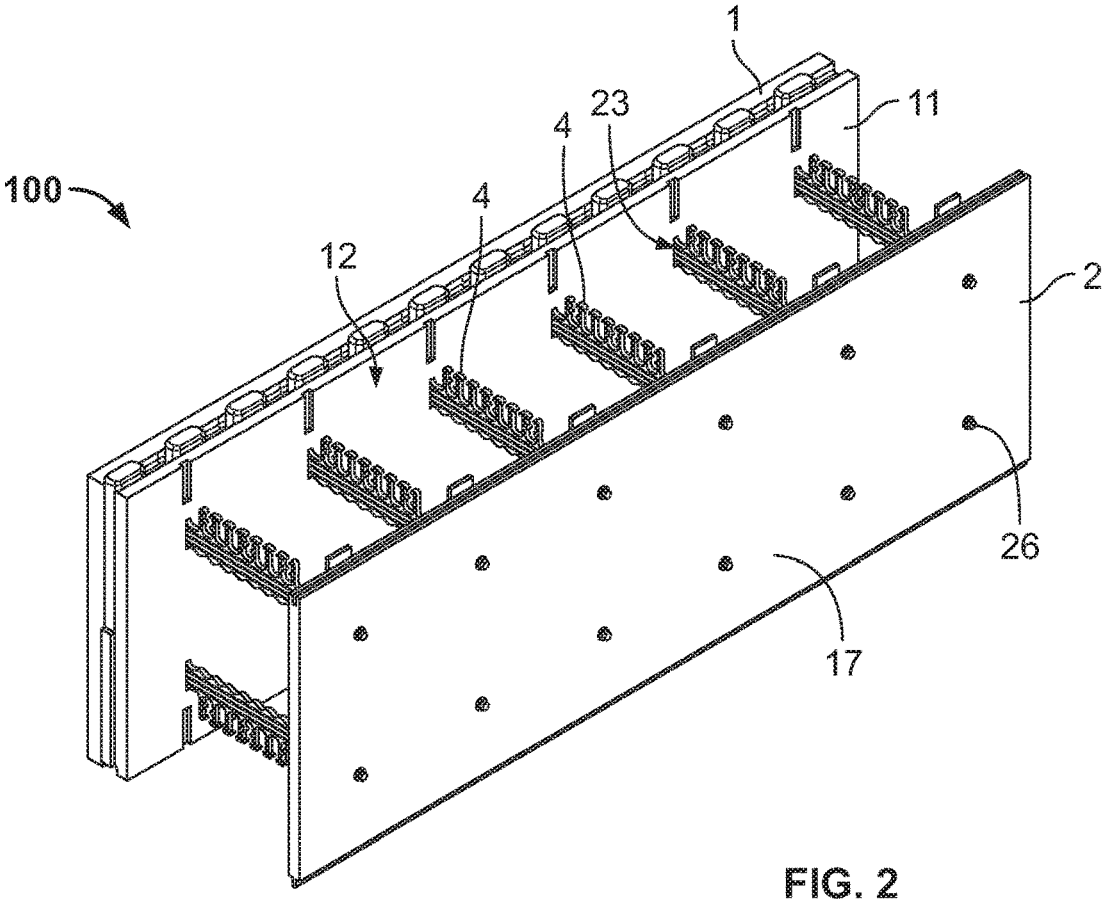
FIG. 2 is a top right perspective view of the concrete form of FIG. 1.
Figure 3:
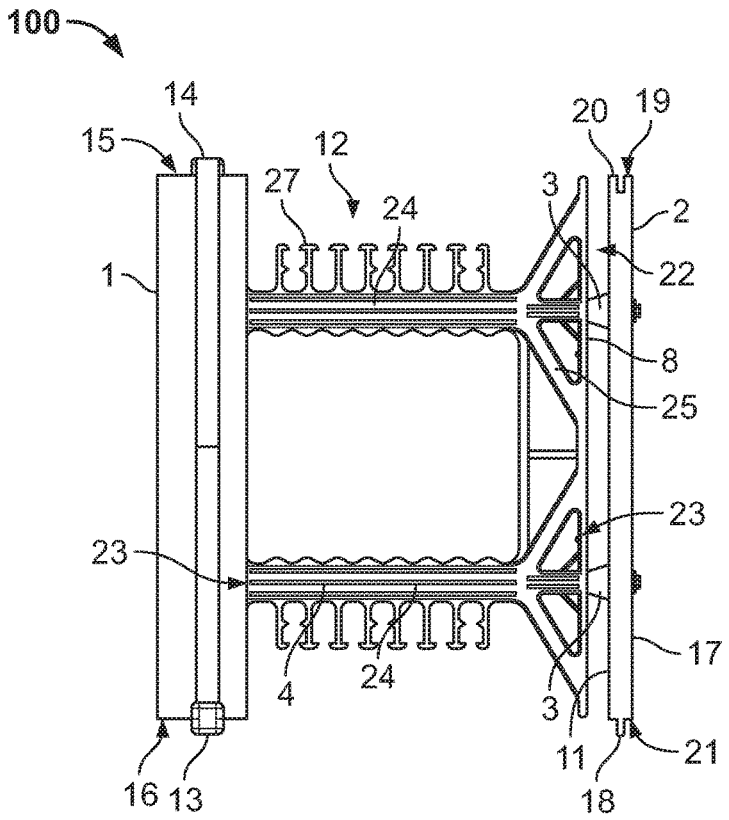
FIG. 3 is a front view of the concrete form of FIG. 1.
Figure 4:
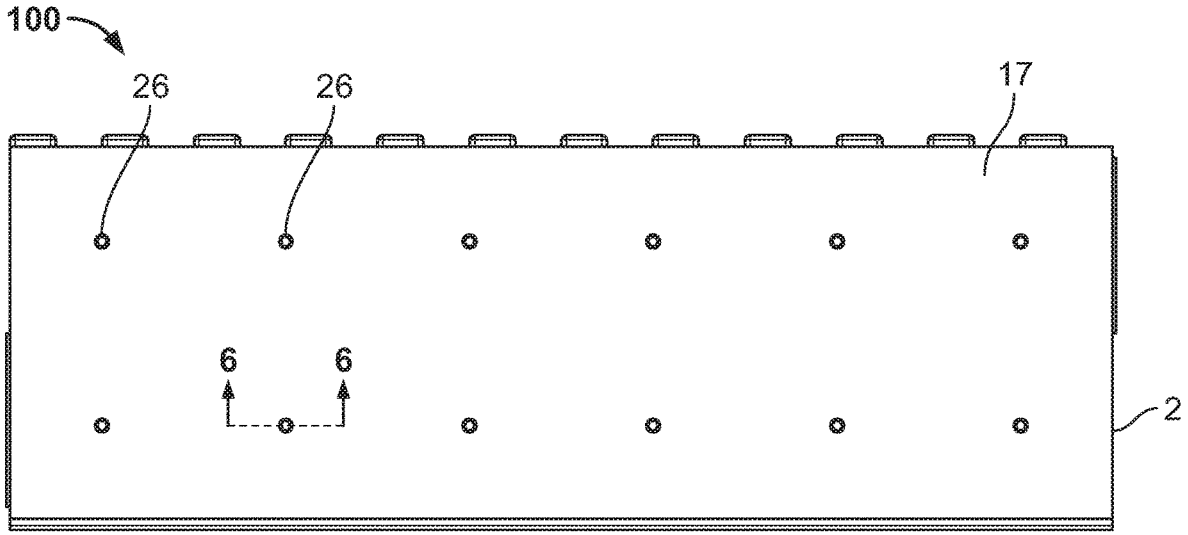
FIG. 4 is a side view of the concrete form of FIG. 1.

The concrete forms 100 generally include one or more cross ties 4 connected to and separating the sidewalls 1, 2. The concrete forms 100 in the embodiments of FIGS. 1-6 and 10-21 have a plurality of cross ties 4 arranged in parallel at regular spaced intervals between the sidewalls 1, 2. The cross tie 4 in the embodiment of FIGS. 1-6 has opposed ends 23, and the sidewalls 1, 2 are directly or indirectly connected to the ends 23 of the cross ties 4. The cross tie 4 as shown in FIGS. 1-3 has multiple parallel branches 24 that extend between the sidewalls 1, 2, and one or more bridges or web members 25 that connect the branches 24 to form a unitary, multi-branched cross tie 4. The cross tie 4 in FIGS. 1-3 has a bridge 25 located at the end 23 that is connected to the removable sidewall 2, with the bridge 25 having multiple members forming a reinforced structure.

In general, the cross tie 4 is configured so that the end 23 to be connected to the removable sidewall 2 includes a securement structure for such connection. For example, the cross ties 4 in the embodiments of FIGS. 1-6 and 10-21 include one or more securement plates 8 that can be abutted or otherwise engaged by a spacer 3 positioned for securement of the removable sidewall 2 to the cross tie 4. The securement plate 8 can be of sufficient thickness to allow for secure embedding of a screw or other fastener 26 within the plate 8. The cross tie 4 in FIGS. 1-6 has a single securement plate 8 at one end 23 that spans between the two branches 24, and it is understood that if this cross tie 4 is configured for connection to two removable sidewalls 2, such a securement plate 8 and/or the bridges 25 may be present on both ends 23 of the cross tie 4. The cross tie 4 in FIGS. 10-18 includes multiple branches 24 connected by bridges 25 formed by single members extending between the branches 24 proximate both ends 23, with each branch 24 having a securement plate 8 at one or both ends 23. The concrete forms 100 in FIGS. 19-21 have separate upper and lower cross ties 4 each formed as a single branch 24 having a securement plate 8 at one or both opposed ends 23. In one embodiment, the cross ties 4 may have additional structure for securing the connection with the spacer 3 and the removable sidewall 2, such as pre-formed holes or other structures designed for engaging a fastener 26. In the embodiments of FIGS. 1-6 and 10-21, the securement plates 8 are simply flat surfaces, and holes for insertion of fasteners 26 in the form of screws or bolts may be formed by pre-drilling or punching, or by screwing the fastener 26 directly into the securement plate 8. It is understood that the cross ties 4 in the various embodiments may include structures for engaging the insulating sidewall 1 as well, including potentially enlarged portions and/or an additional bridge 25 embedded within the insulating sidewall 1. The cross ties 4 in the embodiments of FIGS. 1-6 and 10-21 include structures to increase surface area engagement with concrete surrounding the cross ties 4 and/or provide greater structural reinforcement, such as fingers 27 protruding from the branch 24, ridges, flanges, and other such structures.

In one embodiment, the concrete form 100 includes one or more securement spacers 3 positioned in between the removable sidewall 2 and the end 23 of the cross tie 4. The spacers 3 can be configured to separate the cross tie 4 from the removable sidewall 2 such that the removable sidewall 2 does not directly contact the cross tie 4. In this configuration, poured concrete can fill gaps 22 between the removable sidewall 2 and portions of the cross tie 4. This allows the end 23 of the cross tie 4 to be embedded within and/or recessed from the exposed surface of the resulting concrete after the removable sidewall 2 is removed, creating greater surface uniformity on the exposed surface of the concrete structure than would otherwise be if the removable sidewall 2 was directly affixed to the cross tie 4. In one embodiment, the spacers 3 are configured to be connected to the removable sidewall 2 and the end 23 of the cross tie 4, such as by a screw or other fastener 26, and these connections may be removable or permanent. The spacers 3 may be at least removably connected to the cross tie 4 in one embodiment, permitting the spacers 3 to be removed from the concrete structure with or after removal of the removable sidewall 2. The spacers 3 in this configuration are also formed as separate pieces from the cross tie 4. The spacers 3 may additionally or alternately be removably connected to the removable sidewall 2, and in the embodiments of FIGS. 1-6 and 10-21, the spacers 3 are removably connected to both the removable sidewall 2 and the cross tie 4.

FIGS. 6-9 illustrate in greater detail one embodiment of a spacer 3 that is usable in connection with the concrete form 100, and this spacer 3 configuration is generally used in the embodiments of concrete forms 100 in FIGS. 1-6 and 10-21. The spacer 3 in FIGS. 6-9 includes a body portion or spacer body 6 with a dowel portion 7 projecting outward from the spacer body 6. The spacer body 6 is configured to space the removable sidewall 2 from the cross tie 4 and the dowel portion 7 is configured to fit within a complimentary hole 30 defined in the removable sidewall 2. The spacer body 6 in FIGS. 6-9 has two opposed sides 28, 29, with one side 28 (which may be referred to as a first side) configured to engage and/or abut the inner surface 11 of the removable sidewall 2 and the opposite side 29 (which may be referred to as a second side) configured to engage and/or abut the end 23 of the cross tie 4, e.g., at the plate 8. The sides 28, 29 of the spacer body 6 in FIGS. 6-9 define planar surfaces that abut planar surfaces of the removable sidewall 2 and cross tie 4, respectively. The dowel portion 7 projects from the side 28 of the spacer body 6 that abuts the removable sidewall 2. The dowel portion 7 is received within the hole 30 in the removable sidewall 2, and the first side 28 of the spacer body 6 is wider than the dowel portion 7 and abuts and/or engages the inner surface 11 of the removable sidewall 2 proximate the hole 30. The holes 30 in the removable sidewall 2 have a recessed or countersunk portion on the inner surface 11 that receives both the dowel portion 7 and the fastener 26, and a narrower portion extending completely through the removable sidewall 2 that receives only the fastener.

Figure 6:
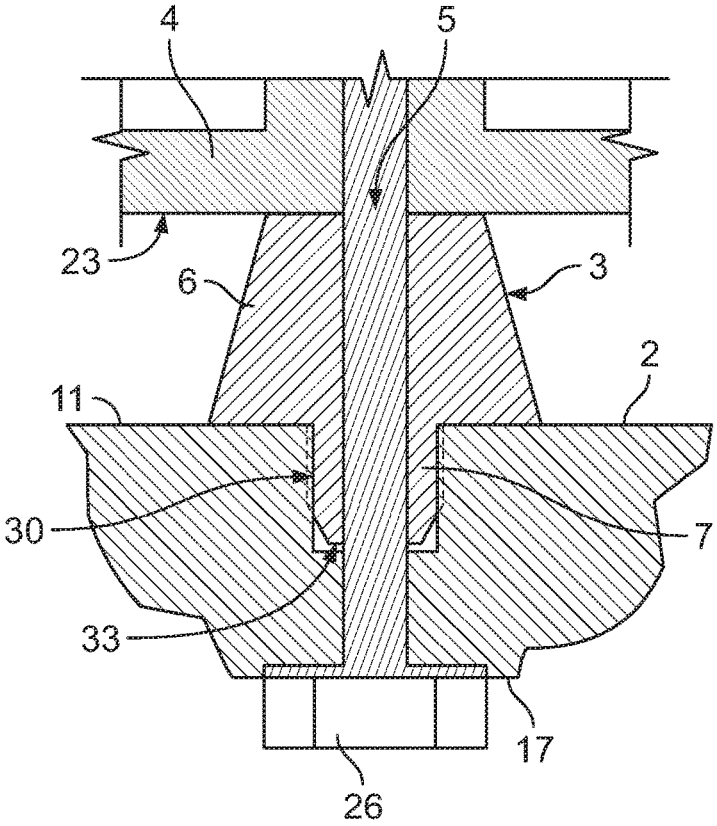
FIG. 6 is a cross-section view taken along line 6-6 in FIG. 4.
Figure 7A:
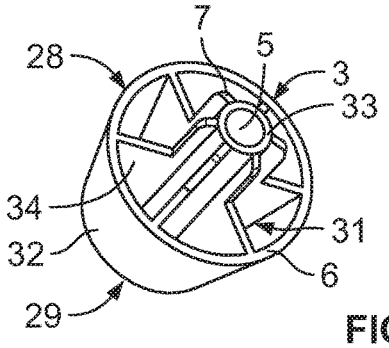
FIGS. 7A-7C are perspective views of one embodiment of a spacer according to aspects of the present disclosure.
Figure 8A:
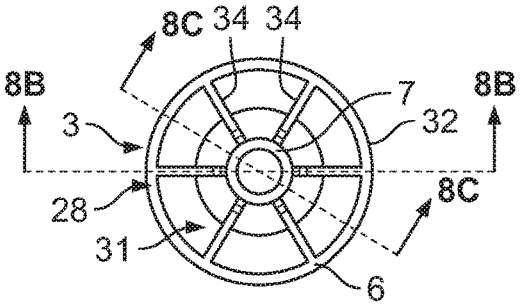
FIG. 8A is a top view of the spacer of FIGS. 7A-7C.
Figure 7B:
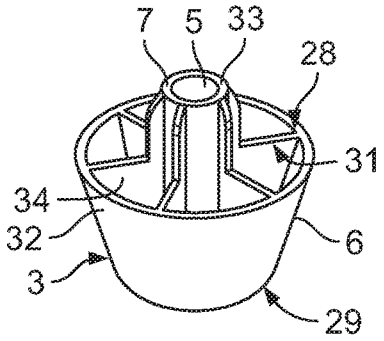
Figure 8B:
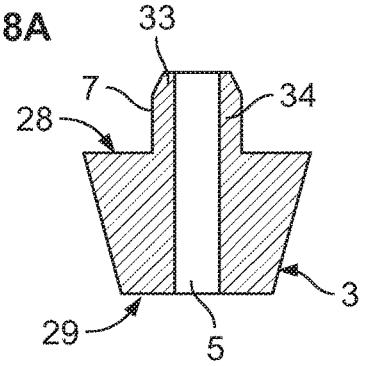
FIG. 8B is a cross-section view taken along lines 8B-8B in FIG. 8A.
Figure 7C:
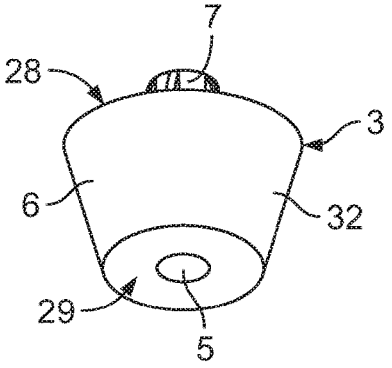
Figure 8C:
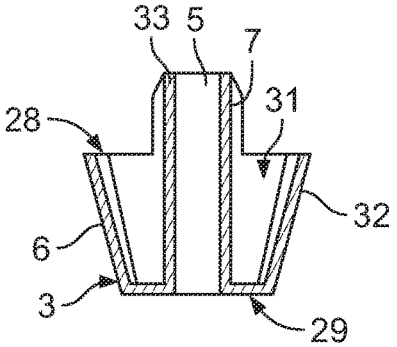
FIG. 8C is a cross-section view taken along lines 8C-8C in FIG. 8A.
Figure 9:
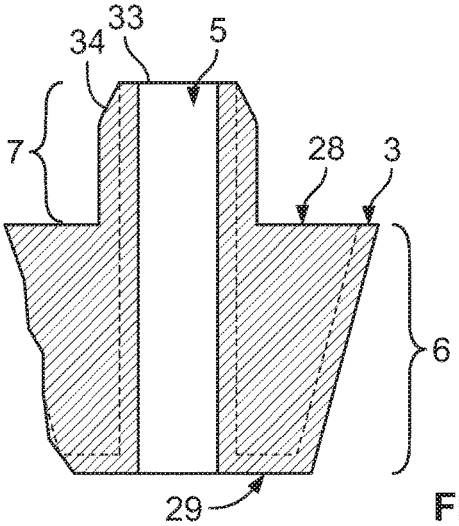
FIG. 9 is an enlarged partial cross sectional view of a portion of the spacer in FIG. 8B, with broken lines showing structures hidden from view.
Figure 8D:
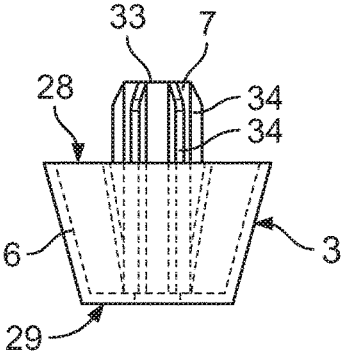
FIG. 8D is a cross-section view taken along lines 8D-8D in FIG. 8A.
Figure 10:
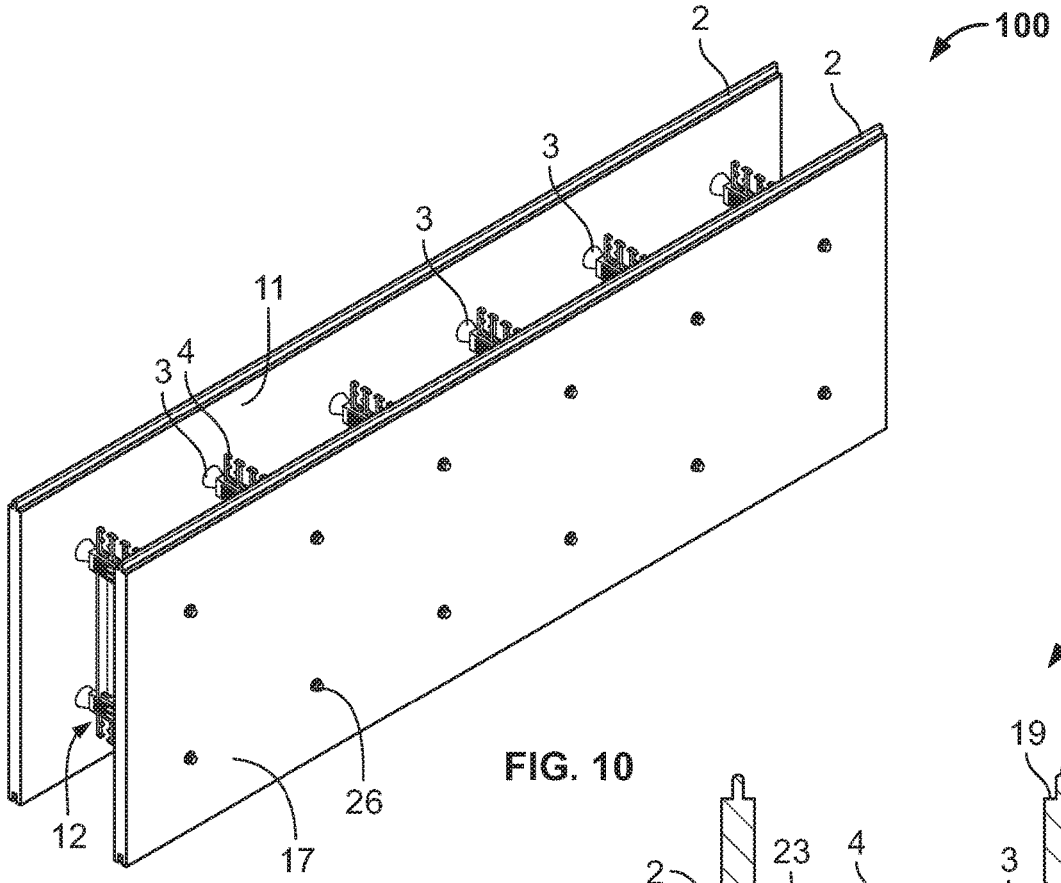
FIG. 10 is a top right perspective view of another embodiment of a concrete form having a two removable sidewalls according to aspects of the present disclosure.
Figure 11:
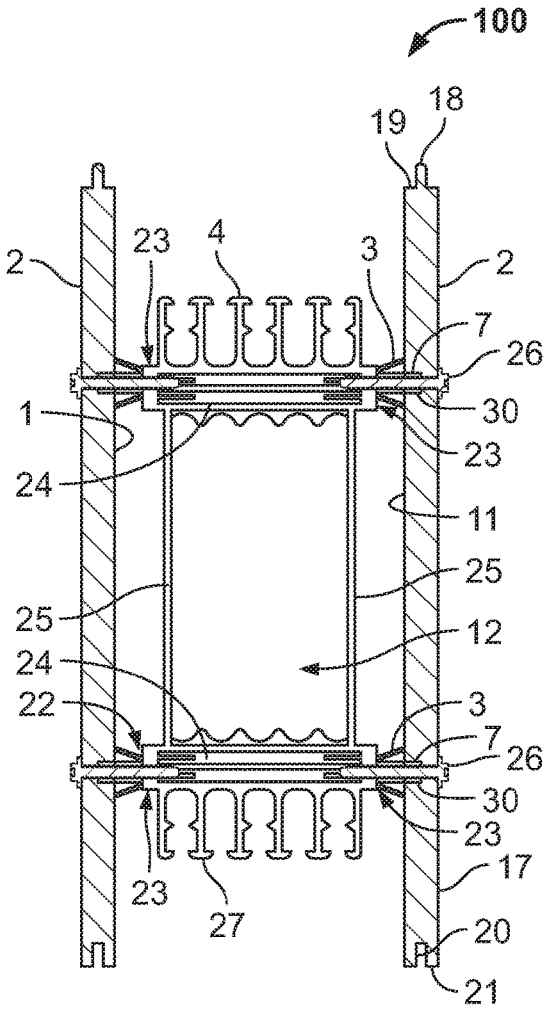
FIG. 11 is a front cross-sectional view of the concrete form of FIG. 10.
Figure 12:
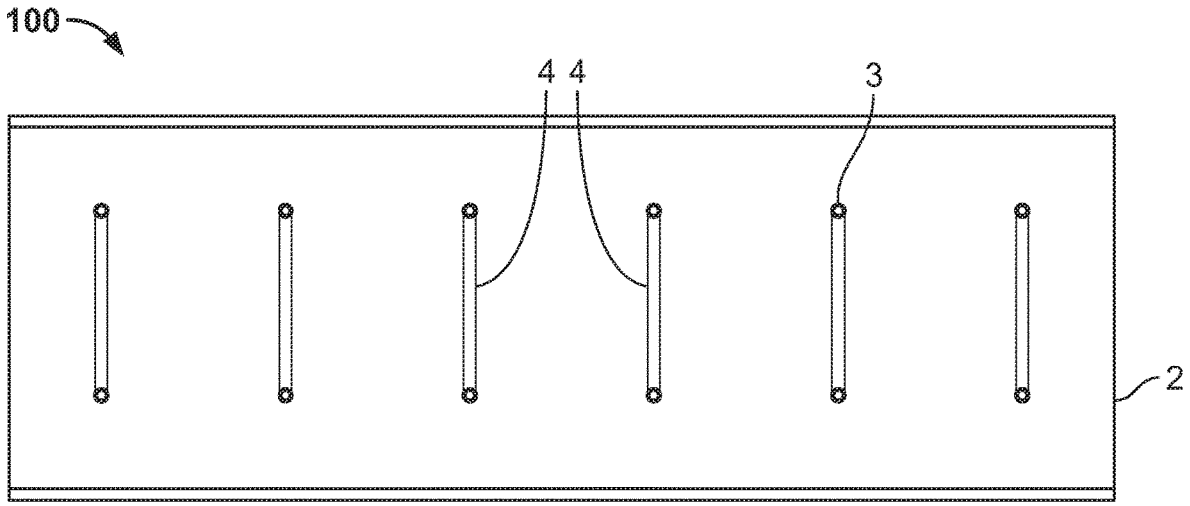
FIG. 12 is a side view of the concrete form of FIG. 10, with broken lines showing structures hidden from view.
Figure 13:
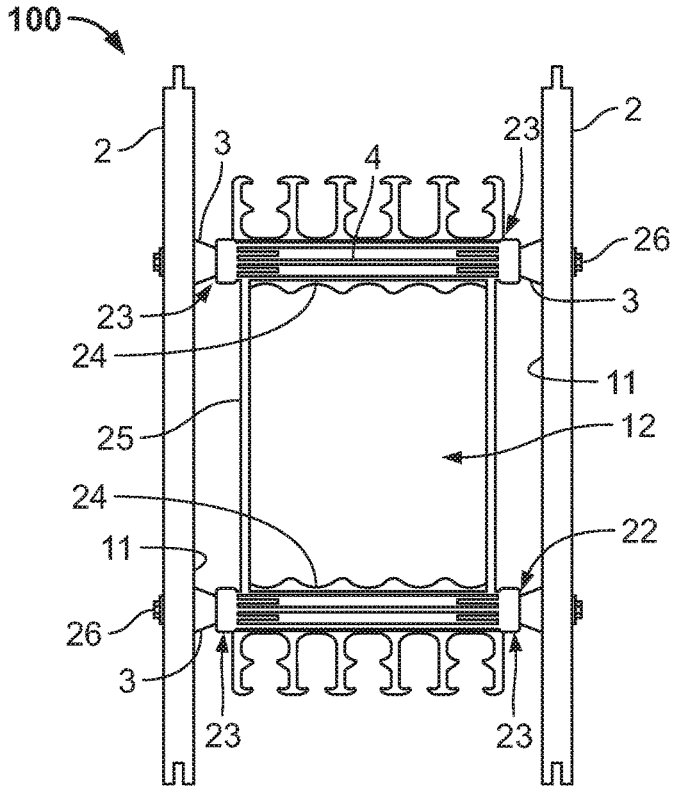
FIG. 13 is a front view of the concrete form of FIG. 10.
Figure 14:
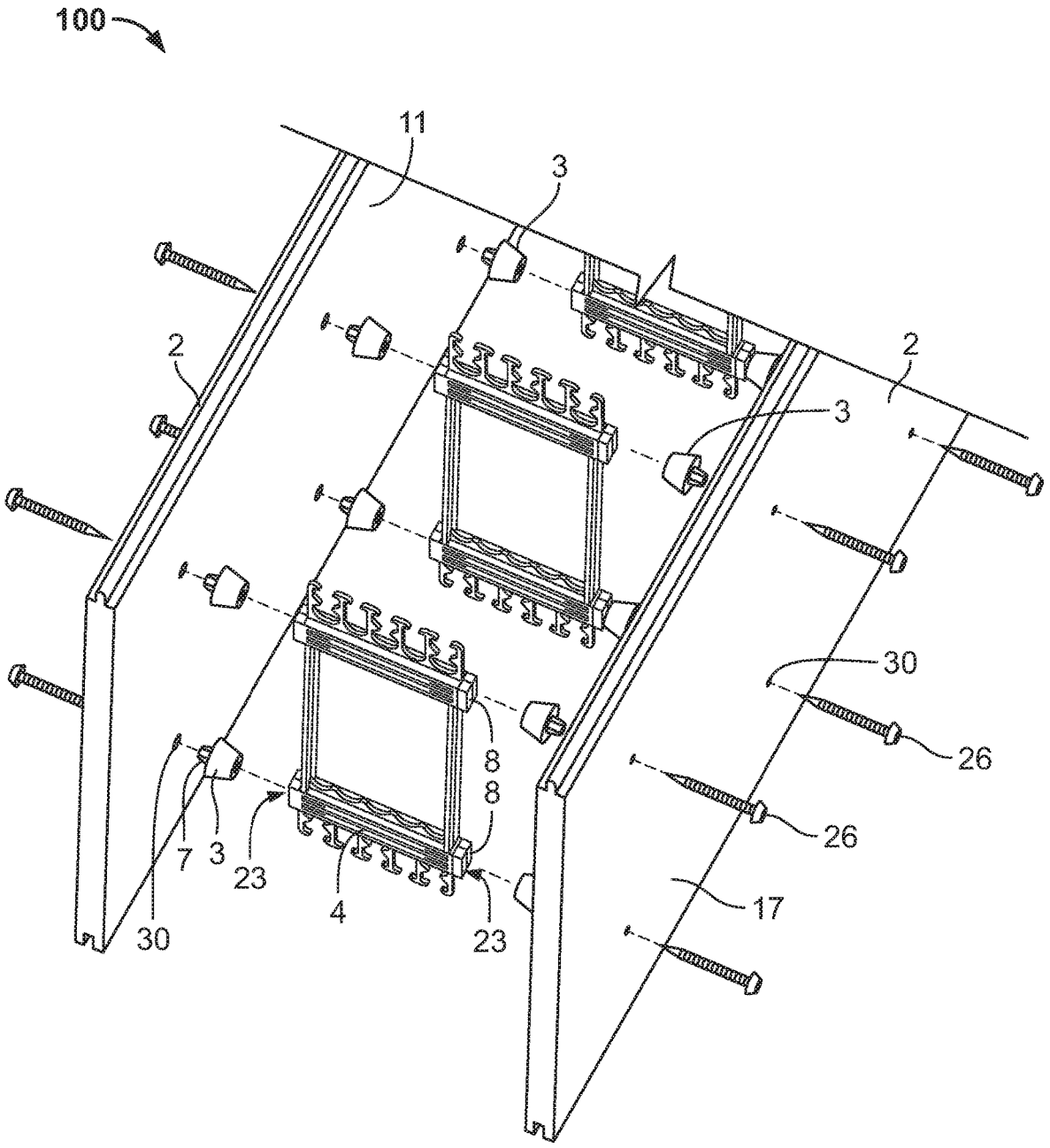
FIG. 14 is a top right exploded perspective view of the concrete form of FIG. 10.
Figure 15:
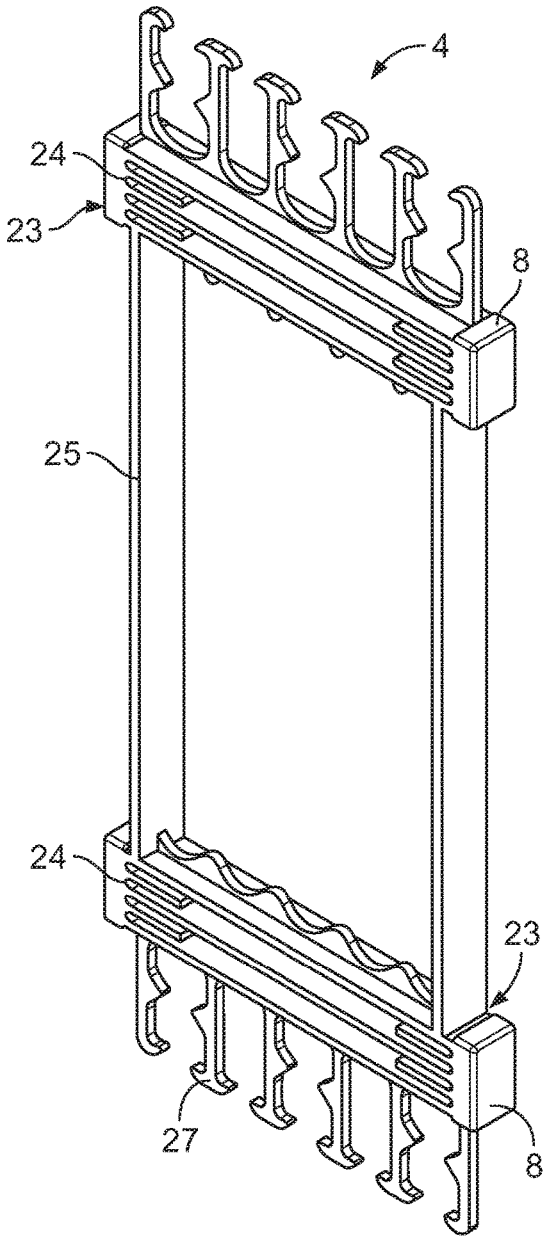
FIG. 15 is a top right perspective view of a cross tie of the concrete form of FIG. 10.
Figure 16:
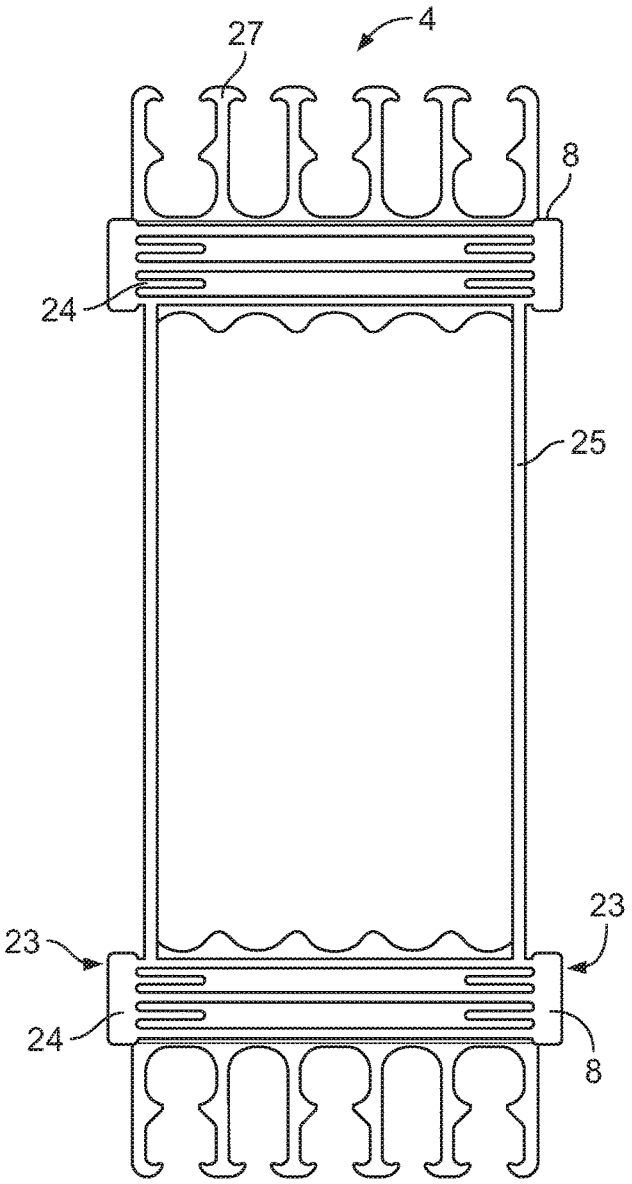
FIG. 16 is a front view of the cross tie of FIG. 15.
Figure 17:
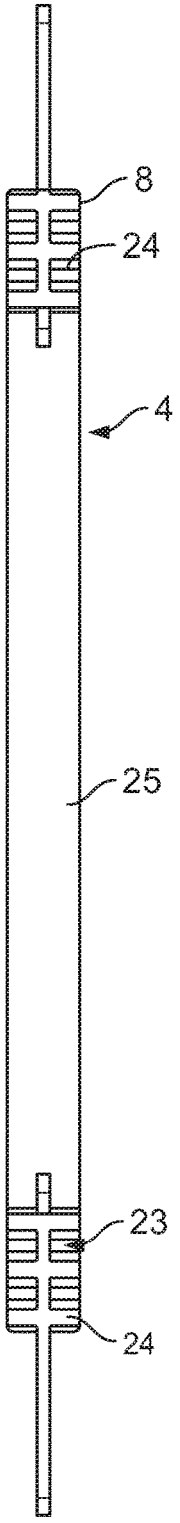
FIG. 17 is a side view of the cross tie of FIG. 15.
Figure 18:
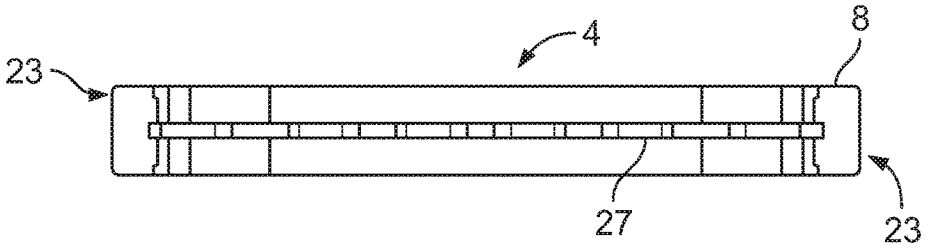
FIG. 18 is a top view of the cross tie of FIG. 15.

The spacer body 6 in the embodiment of FIGS. 6-9 has a partially hollow construction, with a skirt 32 extending from the second side 29 and surrounding and defining an inner cavity 31. It is understood that the spacer body 6 may have a solid construction in other embodiments. In the embodiment of FIGS. 6-9, the dowel portion 7 is affixed to the bottom of the inner cavity 31 of the spacer body 6, on the inner surface of the second side 29, and extends through the inner cavity 31 to project from the first side 28. The spacer 3 also includes ribs 34 within the inner cavity 31 that extend between the skirt 32 and the dowel portion 7. The ribs 34 are arranged in a symmetrical, radiating configuration in order to structurally reinforce both the dowel portion 7 and the skirt 32, as shown in FIG. 8A. The ribs 34 in this embodiment form a portion of the first side 28 to abut the inner surface 11 of the removable sidewall 2 and also extend axially on the projecting portion of the dowel portion 7 to define the outer periphery of the dowel portion 7 and engage the hole 30 in the removable sidewall 2. As shown in FIGS. 6-9, the distal end 33 of the dowel portion 7 has a tapered width, formed by the ribs 34 tapering inward proximate the distal end 33, thereby easing insertion into the hole 30. As shown in FIG. 6, the dimensions of the dowel portion 7 and the hole 30 may be configured such that the outer periphery of the dowel portion 7 (e.g., the ribs 34) tightly engages the inner surfaces of the hole 30, and the axial length of the dowel portion 7 is shorter than the depth of the hole 30.

In one embodiment, the spacer and/or the spacer body 6 is configured to have a width that is larger at the first side 28 and smaller at the second side 29, in order to ease removal of the spacer 3 from the solidified concrete structure after forming. In the embodiment of FIGS. 6-9, the spacer body 6 has a frusto-conical shape defined by the skirt 32 that has a circular cross-section and is tapered continuously and linearly outward from the second side 29 to the first side 28. In other embodiments, the width of the spacer body 6 may be varied using a different structure, such as a structure with a curved or stepped contour. Additionally or alternately, the spacer body 6 may have a different external cross-sectional shape (e.g., as defined by the skirt 32), such as a polygonal or irregular shape.

The spacer 3 may further be configured for a specific connection technique, such as connection using a specific fastener 26. The spacer 3 in the embodiment of FIGS. 6-9 includes a throughway or passage 5 defined through the center axis of the spacer 3, such that the fastener 26 in the form of a screw or bolt can pass through the passage 5 to secure the removable sidewall 2, the spacer 3, and the cross tie 4 together. The passage 5 in this embodiment extends from the distal end 33 of the dowel portion 7 along the entire axial length of the dowel portion 7 and the spacer body 6, exiting at the second side 29 of the spacer body 6. In other embodiments, the spacer 3 may be configured for a different connection technique, such as welding, adhesive bonding, or connection using a different type of fastener 26. For example, the spacer 3 may have structures for engaging a different type of fastener 26, such as a passage 5 with internal threading or mating teeth for a ratchet-like engagement, locking or retaining tabs, keyed holes, etc. As another example, the spacer 3 may include multiple passages 5 for multiple fasteners 26. Further structures may be used in other embodiments.

A concrete form 100 according to various embodiments described herein may be assembled by connecting the removable sidewall(s) 2 and spacer(s) 3 to the cross tie(s) 4 in a configuration to permit removal of the removable sidewall(s) 2 and, optionally, the spacer(s) 3 as well. As shown in FIGS. 1-2, 10, 12, and 14, the concrete form 100 may include a plurality of cross ties 4 distributed along the length of the concrete form 100, and one or more spacers 3 may be connected between each cross tie 4 and each removable sidewall 2. In the embodiments of FIGS. 1-6 and 10-18, two spacers 3 are connected between each cross tie 4 and the removable sidewall 2, with one spacer 3 located at each branch 24 of the cross tie 4, and in the embodiment of FIGS. 19-21, one spacer 3 is connected between each cross tie 4 and the removable sidewall 2. Generally, each removable sidewall 2 is removably connected to the end 23 of each cross tie 4, and each spacer 3 is connected between the removable sidewall 2 and the cross tie 4, such that the spacer 3 is removable from one or both of the removable sidewall 2 and the cross tie 4. In one embodiment, the spacers 3 are removably connected to the cross tie 4 and are further connected to the removable sidewall 2 in a manner that permits the spacers 3 to be removed from the cross tie 4 simultaneously with removal of the removable sidewall 2, as a single unit. In the embodiments of FIGS. 1-6 and 10-21, the spacers 3 are removably connected to the cross tie 4 and the removable sidewall 2 by a fastener 26 (e.g., a screw or bolt), such that a single fastener 26 connects the spacer 3 to both the cross tie 4 and the removable sidewall 2. The engagement between the dowel portion 7 of the spacer 3 and the removable sidewall 2 also assists in forming this removable connection.

Figure 5:
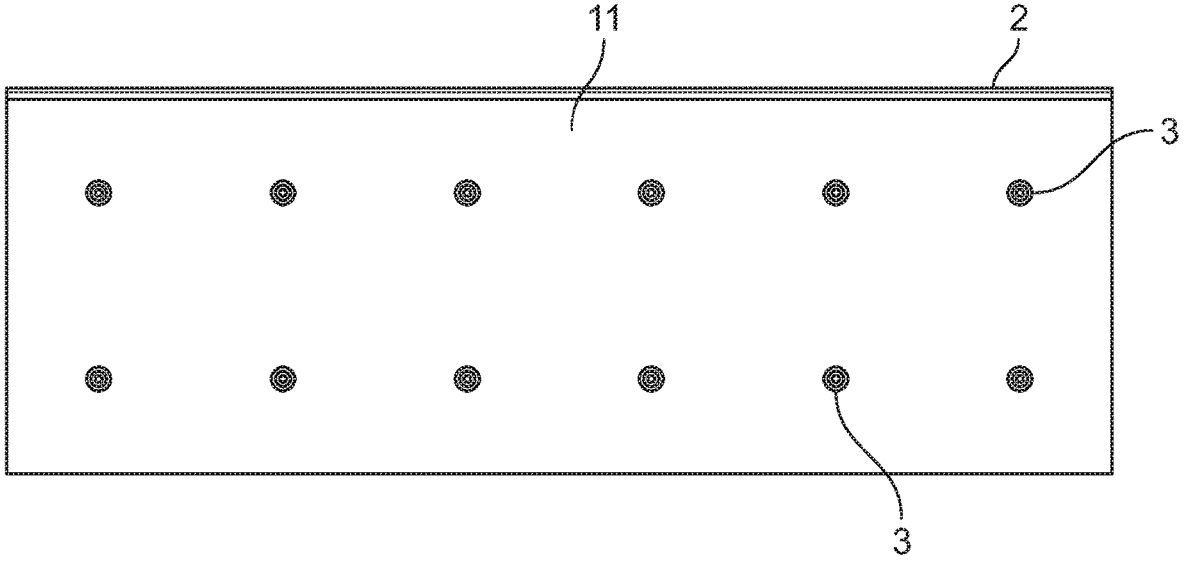
FIG. 5 is a side view of an inner surface of a removable sidewall of the embodiment of FIG. 1 with spacers mounted on the sidewall.

Assembling a concrete form 100 with one insulating sidewall 1 and one removable sidewall 2, such as shown in FIGS. 1-6, 20, and 21 generally includes removably connecting the removable sidewall 2 to the cross ties 4. The insulating sidewall 1 may be permanently or removably connected to the cross ties 4 using a variety of techniques, and these components may be connected contemporaneously with connection of the removable sidewall 2 or the cross ties 4 may be connected to the insulating sidewall 1 in a previous step. In one embodiment, the spacers 3 may be connected to the removable sidewall 2 before insertion of the fasteners 26 by insertion of the dowel portions 7 of the spacers 3 into the holes 30 in the inner surface 11 of the removable sidewall 2. FIG. 5 shows a removable sidewall 2 with spacers 3 connected by insertion of the dowel portions 7 into the holes 30 on the inner surface 11. In this embodiment, the removable sidewall 2 and the spacers 3 can then be connected to the cross ties 4 by positioning the removable sidewall 2 to align the spacers 3 with the connection portions on the ends 23 of the cross ties 4, e.g., the securement plates 8. The fasteners 26 can then be inserted into the holes 30 in the removable sidewall 2 and through the passages 5 of the spacers 3 and into the securement plates 8 at the ends 23 of the cross ties 4 to connect the removable sidewall 2 to the cross ties 4 with the spacers 3 separating the removable sidewall 2 from the cross ties 4. Assembling a concrete form 100 with two removable sidewalls 2, such as shown in FIGS. 10-14, 19, and 21, generally includes removably connecting both of the removable sidewalls 2 to opposite ends 23 of the cross ties 4, and the same techniques for connection of the single removable sidewall 2 can be used for connection of the two removable sidewalls 2.

A concrete forming assembly 10 may be constructed of one or more concrete forms 100 according to embodiments shown and described herein. Such a concrete forming assembly 10 may include concrete forms 100 stacked vertically, as shown in FIGS. 19-21, and/or concrete forms 100 placed horizontally adjacent to each other. This assembly of concrete forms 100 may be arranged so that the inner surfaces 11 of all of the sidewalls 1, 2 of the concrete forms define a continuous space or cavity 12 configured to receive poured concrete. In one embodiment, multiple concrete forms 100 having different combinations of insulating sidewalls 1 and removable sidewalls 2 may be configured for stacking upon each other in a consistent manner to form a stacked assembly 10 of a plurality (i.e., two or more) of concrete forms 100 stacked in a vertical configuration.

FIGS. 19-21 illustrate various different configurations of concrete forms 100 stacked upon each other, and it is understood that more than two concrete forms 100 may be stacked in each stacked assembly 10, in any combination. It is also understood that the assembly 10 may include multiple additional concrete forms 100 placed laterally alongside the stacked concrete forms 100. In the stacked assemblies 10 shown in FIGS. 19-21, the sidewalls 1, 2 all have inner surfaces 11 facing toward the cavity 12 between the sidewalls 1 and/or 2, such that the cross ties 4 extend through the cavity 12 between the sidewalls 1 and/or 2. The sidewalls 1, 2 in these assemblies 10 each have an inner surface 11 that is flush with the inner surface 11 of the sidewall 1 and/or 2 stacked on top thereof. In other words, the general plane of the inner surface 11 of the lower sidewall 1, 2 and the sidewall 1, 2 stacked on top of the lower sidewall 1, 2 are aligned with each other. As used herein, two surfaces may be considered to be "flush" and "aligned" if the two surfaces are within ½ inch away from exact alignment in one embodiment, or ¼ inch away from exact alignment in another embodiment, or ⅛ inch away from exact alignment in another embodiment, or 1/16 inch away from exact alignment in a further embodiment. The various sidewalls 1, 2 are configured for stacking with each other to achieve this configuration.

The insulating sidewalls 1 described herein may include mating structures for stacking purposes, such as teeth 13 and recesses 14 arranged in an alternating manner on the top side 15 and the bottom side 16 thereof. In this arrangement, the teeth 13 and recesses 14 on the top side 15 of one insulating sidewall 1 are configured for mating with the teeth 13 and recesses 14 on the bottom side 16 of another insulating sidewall 1 stacked on top of the first insulating sidewall 1. The insulating sidewalls 1 in the embodiment shown in FIGS. 19-21 all have substantially the same thickness and positioning of the mating structures 13, 14, and thus, the inner surfaces 11 and the outer surfaces 17 of two insulating sidewalls 1 stacked upon each other will be flush.

The removable sidewalls 2 described herein may also include mating structures for stacking purposes, such as a projection or projections 18 on the top side 19 and a recess or recesses 20 on the bottom side 21, as shown in FIGS. 10-14 and 19-21. The removable sidewalls 2 in FIGS. 1-4 have a transposed configuration, with the recess(es) 20 on the top side 19 and the projection(s) on the bottom side 21. The projection(s) 18 on one removable sidewall 2 fits within the recess(es) 20 on another removable sidewall 2 stacked on top of the first removable sidewall 2. The removable sidewalls 2 in the embodiments shown in FIGS. 1-4, 10-14, and 19-21 all have substantially the same thickness and positioning of the mating structures 18, 20, and thus, the inner surfaces 11 and the outer surfaces 17 of two removable sidewalls 2 stacked upon each other will be flush.

The thicknesses of the removable sidewalls 2 described herein may be smaller than the thicknesses of the insulating sidewalls 1, and the mating structures of the removable sidewalls 2 may be different from the mating structures of the insulating sidewalls 1. These differences can present challenges in stacking a removable sidewall 2 upon an insulating sidewall 1 or vice-versa. In the embodiments shown in FIGS. 19-21, the components of the concrete forms 100, including the thicknesses of the sidewalls 1, 2 and the widths of the cross ties 4 and spacers 3, are configured such that the inner surfaces 11 of an insulating sidewall 1 and a removable sidewall 2 will be flush when stacked on top of each other. FIG. 19 illustrates a stacked assembly 10 that includes a first concrete form (A) with two removable sidewalls 2 stacked on top of a second concrete form (B) with two insulating sidewalls 1, where the inner surfaces 11 of all stacked sidewalls 1, 2 are flush. FIG. 20 illustrates a stacked assembly 10 that includes a first concrete form (A) with one insulating sidewall 1 and one removable sidewall 2 stacked on top of a second concrete form (B) with two insulating sidewalls 1, where the inner surfaces 11 of all stacked sidewalls 1, 2 are flush. FIG. 21 illustrates a stacked assembly 10 that includes a first concrete form (A) with two removable sidewalls 2 stacked on top of a second concrete form (B) with one insulating sidewall 1 and one removable sidewall 2, where the inner surfaces 11 of all stacked sidewalls 1, 2 are flush.

In FIGS. 19-21, it is shown that when a removable sidewall 2 is stacked on top of an insulating sidewall 1, the outer surface 17 of the removable sidewall 2 is recessed from and misaligned with the outer surface 17 of the insulating sidewall 1, due to the smaller thickness of the removable sidewall 2. In one embodiment, the thickness of the removable sidewall 2 is less than half of the thickness of the insulating sidewall 1. Additionally, in one embodiment, the thickness of the removable sidewall 2 may be configured such that the entire removable sidewall 2 sits between the teeth 13 and the inner surface 1 of the insulating sidewall 1, and the outer surface 17 of the removable sidewall 2 may abut the side surfaces of the teeth 13 in one embodiment. To enable this configuration, the thickness of the removable sidewall 2 is less than or equal to the distance between the side surfaces of the teeth 13 and the inner surface 11 of the insulating sidewall 1. In the embodiments of FIGS. 19-21, the thickness of the removable sidewall 2 may be approximately equal to this distance. The stacking configurations described herein for stacking a removable sidewall 2 on top of an insulating sidewall 1 may be used in the same manner for stacking an insulating sidewall 1 on top of a removable sidewall 2. In such a configuration, the removable sidewall 2 may be oriented so the recess(es) 20 are on the top side 19 to abut the bottom side 16 of the insulating sidewall 1, such as in FIGS. 1-4, or the removable sidewall 2 may be provided without projections 18 on the top side 19. In any embodiment where the inner surfaces 11 of all sidewalls 1, 2 are flush with each other, the cross ties 4 and spacers 3 are dimensioned so that the spacing between the inner surfaces 11 of all sidewalls 1, 2 are equal, regardless of the configuration of the sidewalls 1, 2.

Figure 22:
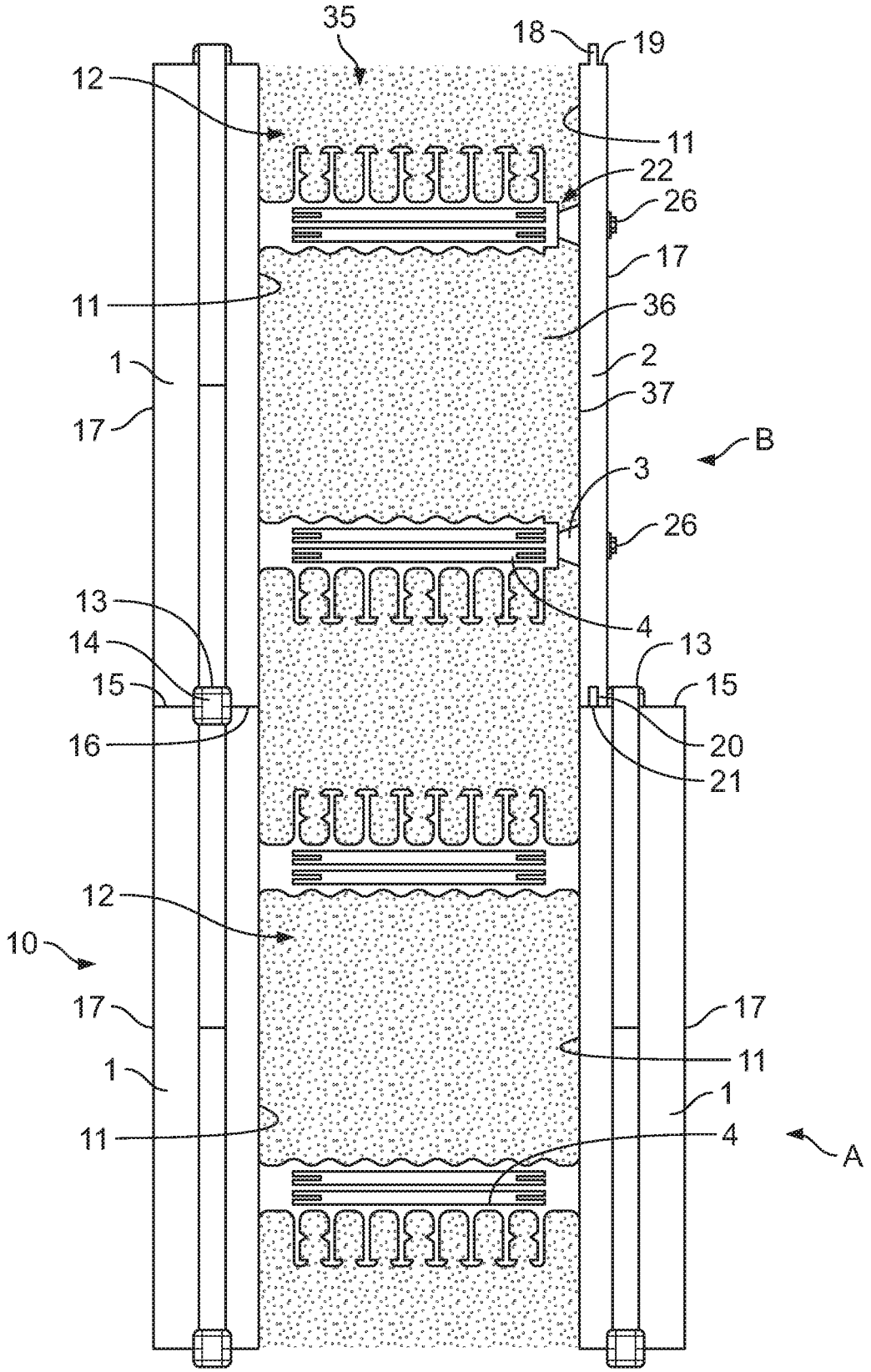
FIG. 22 is a front view schematically illustrating a step in one embodiment a method of forming a concrete structure using the concrete forming assembly of FIG. 20 according to aspects of the present disclosure.

FIGS. 22-25 illustrate one embodiment of a method of forming a concrete structure 200 using a concrete forming assembly 10 and concrete forms 100 according to embodiments described herein. In this method, a concrete forming assembly 10 including one or more concrete forms 100 is assembled, which may include assembly of individual concrete forms 100 and/or stacking and alignment of multiple concrete forms 100 to form the assembly 10 as shown in FIGS. 19-21. As described herein, some or all of the concrete forms 100 may be provided as prefabricated concrete forms 100 in one embodiment, so that no assembly of the individual concrete forms 100 is necessary. The assembled concrete forming assembly 10 defines a cavity 12 for receiving concrete and forming the concrete structure. The concrete structure can be formed by pouring or otherwise introducing the flowable concrete into the cavity 12 and then allowing the concrete to cure or solidify. FIG. 22 illustrates the concrete forming assembly 10 of FIG. 20 with concrete 35 filling the cavity 12 to form a concrete structure 36 in the form of a wall.

Figures 23, 23A:
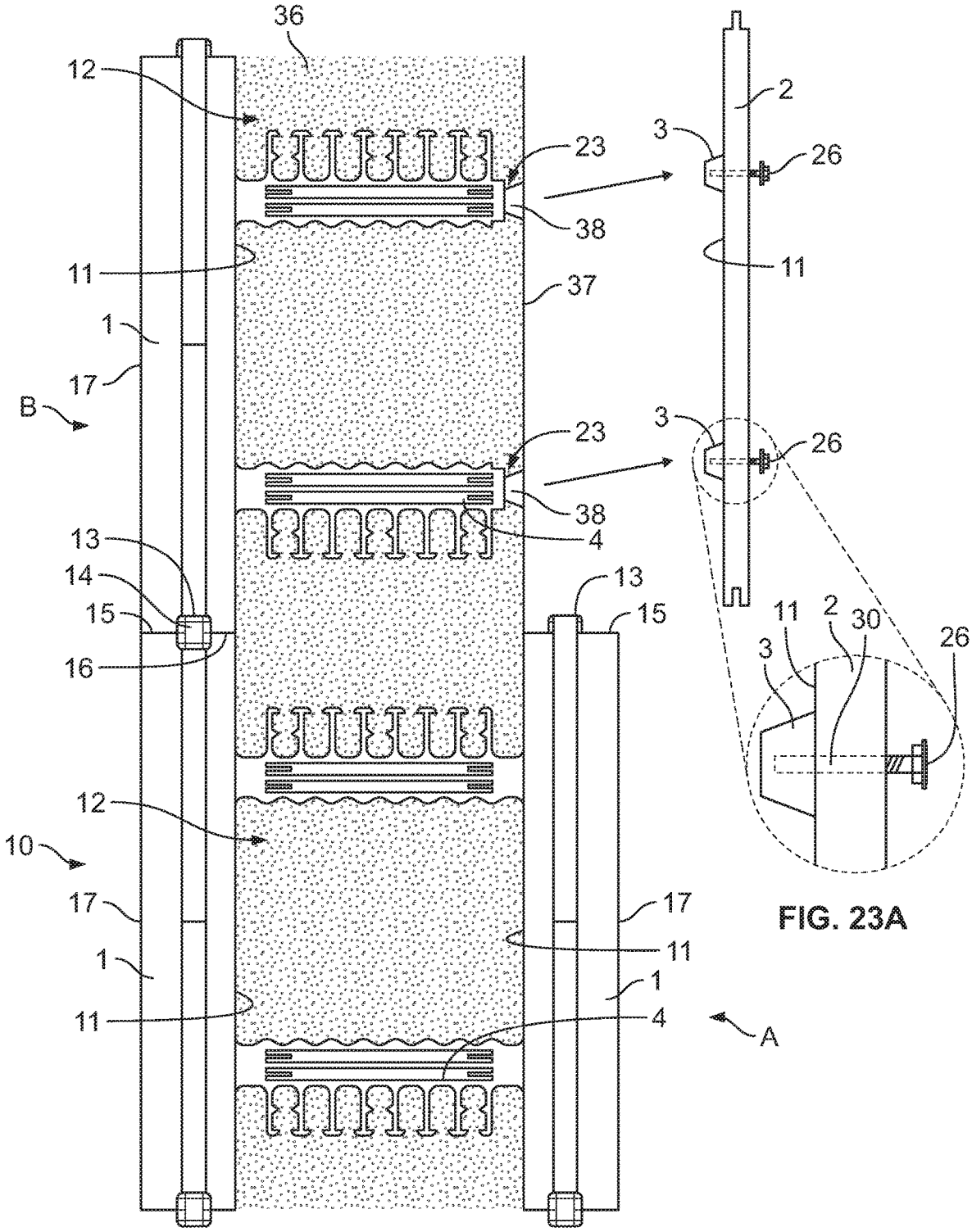
FIG. 23 is a front view schematically illustrating another step in the method of FIG. 22.
FIG. 23A is an enlarged view of a portion of FIG. 23.
Figure 24:
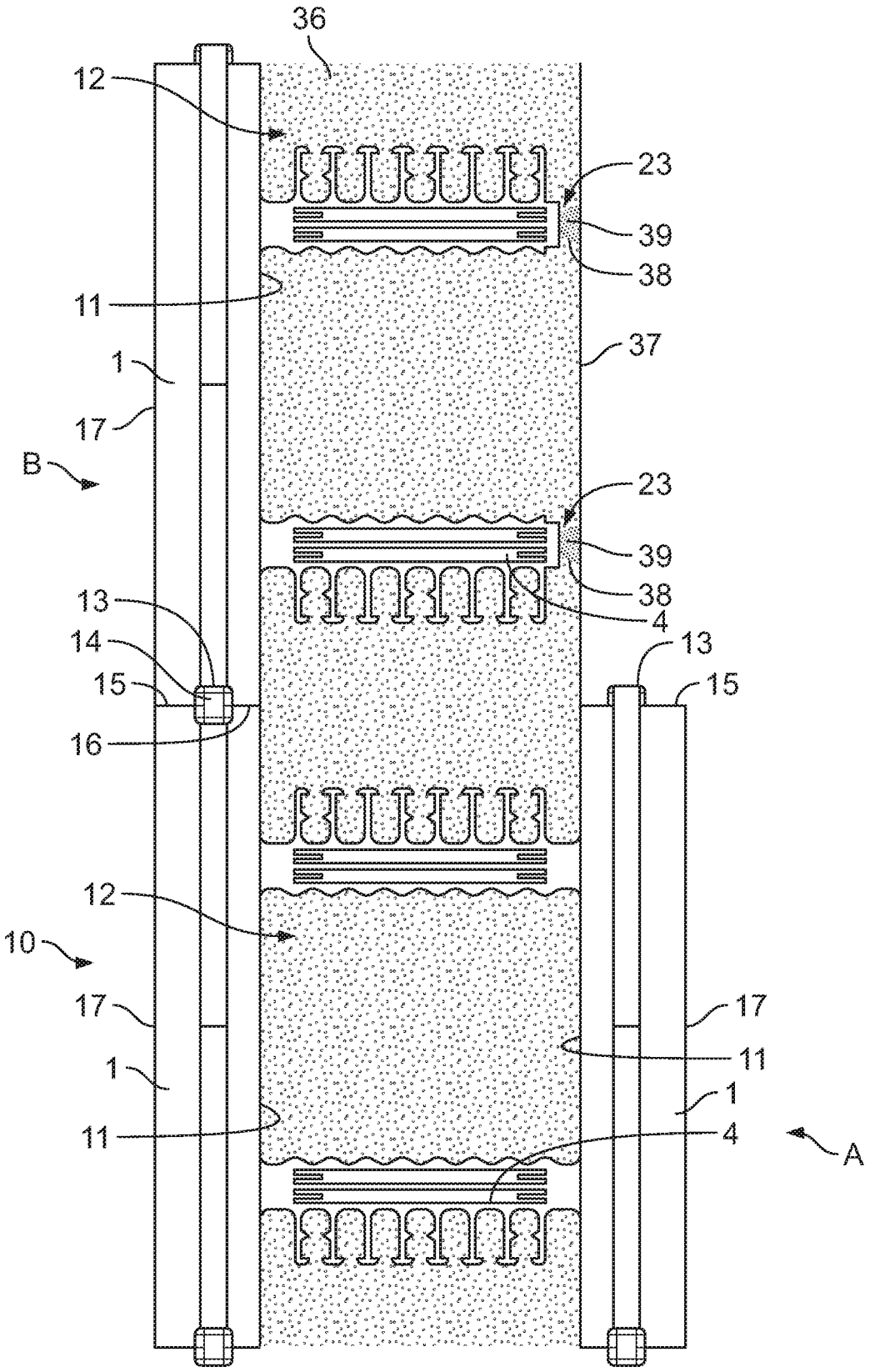
FIG. 24 is a front view schematically illustrating another step in the method of FIG. 22.
Figure 25:
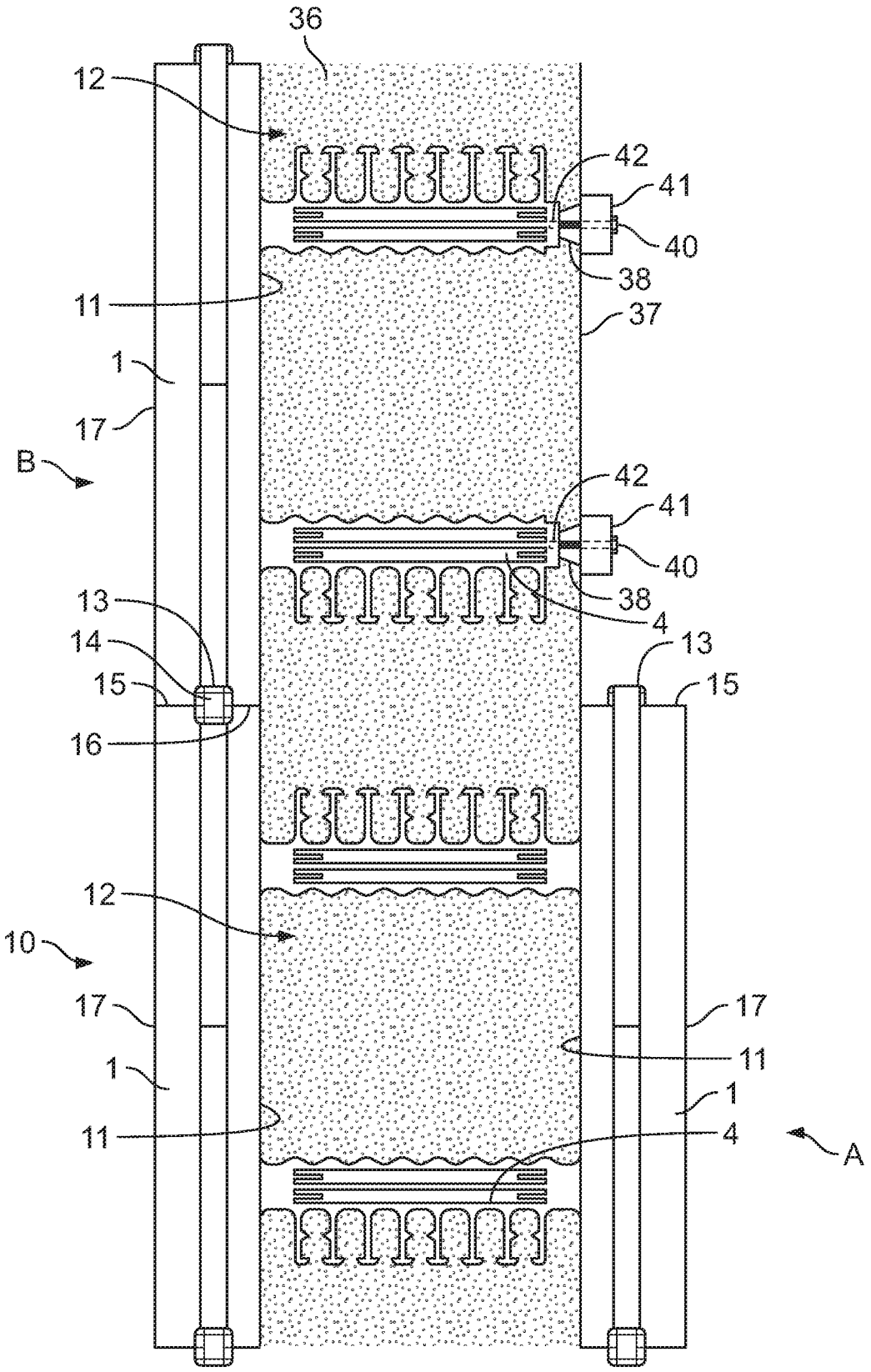
FIG. 25 is a front view schematically illustrating attachment of a secondary structure to the exposed surface of the concrete structure formed using the method of FIGS. 22-24.

After the concrete 35 is introduced and solidified, any removable sidewalls 2 can be removed from the assembly 10 to expose one or more exterior surfaces 37 of the concrete structure 36. FIG. 23 illustrates removal of the removable sidewall 2 to expose an exterior surface 37 of the concrete structure 36. The spacers 3 may also be removed from the cross ties 4 and the concrete structure 36, and in one embodiment, the spacers 3 may be removed simultaneously with the removable sidewall 2 such that the removable sidewall 2 and some or all of the spacers 3 are removed together as a single unit. In the embodiment of FIG. 23, this is accomplished by partially removing the fasteners 26, so that the fasteners 26 disengage or disconnect from the cross ties 4 but are still connected to the spacers 3. FIG. 23A illustrates this partial removal of the fastener 26 in greater detail, which is accomplished by turning the fasteners 26 until the fastener 26 is axially displaced to the point that the threads of the screw/bolt no longer engage the cross tie 4. When all of the fasteners 26 have been partially removed as shown in FIGS. 23 and 23A, the removable sidewall 2 can be removed, and all of the spacers 3 will be pulled away from the concrete structure 36 as part of a single unit with the removable sidewall 2. Removal of the spacers 3 leaves recesses 38 in the exterior surface 37 of the concrete structure 36, with at least a portion of the ends 23 of the cross ties 4 exposed within the recesses 38. In one embodiment, as shown in FIG. 24, these recesses 38 may be filled with a filler material 39, such as concrete or a concrete filler, thereby leaving a level exterior surface 37. In another embodiment, as shown in FIG. 25, these recesses 38 may be left open and exposed. The exposed ends 23 of the cross ties 4 may optionally be used as mounting structures in this configuration, such as by using a fastener 40 to connect a secondary structure 41 to the concrete structure 26. The fastener 40 may be configured to engage the hole 42 in the end 23 of the cross tie 4 that was previously engaged by the fastener 26 connecting the spacer 3 and the removable sidewall 2. One example of such a secondary structure 41 is a furring strip, and a wide variety of different wall-mounted structures may be connected to the cross ties 4 in such a configuration. It is understood that some of the recesses 38 may be filled and other recesses 38 may be left exposed in some configurations.

The concrete forms 100, concrete forming assemblies 10, and methods described herein provide benefits and advantages that are not provided by existing technologies. For example, the use of the spacers 3 as described herein permits the use of a removable sidewall 2 without leaving connecting structures of the concrete form 100 exposed on the surface of the concrete structure 36. As another example, the removable configurations of the spacers 3 as described herein facilitate the removal of the spacers 3, and even permit removal of multiple spacers 3 simultaneously with removal of the removable sidewall 2. As a further example, the relative sizes and dimensions of the insulated sidewalls 1, the removable sidewalls 2, the cross ties 4, and the spacers 3 as described herein permit concrete forms with any combination of insulated sidewalls 1 and removable sidewalls 2 to be stacked on top of each other to form a relatively smooth and seamless concrete structure 36. Still other benefits and advantages are provided by the configurations described herein, which would be readily recognizable to those skilled in the art.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. The terms "first," "second," "top," "bottom," etc., as used herein, are intended for illustrative and reference purposes only and do not limit the embodiments in any way. The term "plurality," as used herein, indicates any number greater than one, either disjunctively or conjunctively, as necessary, up to an infinite number. The term "removable" as used herein refers to two structures that are connected in a way that permits removal or disconnection of one or both components without fracture or other structural damage. "Providing" an article or apparatus, as used herein, refers broadly to making the article available or accessible for future actions to be performed on the article, and does not connote that the party providing the article has manufactured, produced, or supplied the article or that the party providing the article has ownership or control of the article. Accordingly, while specific embodiments have been illustrated and described, numerous modifications come to mind without significantly departing from the spirit of the invention and the scope of protection is only limited by the scope of the accompanying Claims.

What is claimed is:

1. A concrete form comprising:

a first sidewall and a second sidewall positioned in parallel and spaced relation to each other to define a cavity, with inner surfaces of the first and second sidewalls facing the cavity;

a cross tie having opposed first and second ends and having first and second flat securement plates on the first end, wherein the first sidewall is removably secured to the first end of the cross tie by first and second removable fasteners extending through the first sidewall and embedded in the first and second securement plates, respectively, and the second sidewall is secured to the second end of the cross tie; and first and second spacers positioned between the first sidewall and the first end of the cross tie to define a space between the first sidewall and the cross tie, wherein the first and second spacers are connected to the first sidewall and removably connected to the cross tie by the first and second fasteners, such that the first and second fasteners extend through the first and second spacers, respectively, wherein each of the first and second spacers has a first side engaging the inner surface of the first sidewall and a second side opposite the first side, the second side of the first and second spacers engaging the first and second securement plates, respectively, and wherein the first securement plate has a larger area than the second side of the first spacer, and the second securement plate has a larger area than the second side of the second spacer, and wherein the concrete form is configured for use in forming a concrete structure within the cavity by introducing concrete into the cavity and allowing the concrete to solidify.

2. The concrete form of claim 1, wherein the second sidewall is an insulating sidewall that remains in place as insulation after the concrete structure is formed.

3. The concrete form of claim 2, wherein the first sidewall has a first thickness, and the second sidewall has a second thickness that is greater than the first thickness.

4. The concrete form of claim 3, wherein the second sidewall includes complementary mating teeth and recesses on top and bottom surfaces thereof for stacking with identical insulating sidewalls, and wherein the first thickness of the first sidewall is dimensioned so that the first thickness is less than or equal to a distance between the teeth and the inner surface of the second sidewall.

5. The concrete form of claim 1, wherein the first and second fasteners are screwed directly into the first and second securement plates to connect the first and second fasteners to the first and second securement plates, respectively.

6. The concrete form of claim 1, wherein the first and second spacers are each connected to the first sidewall such that the first sidewall and the first and second spacers are removeable as a single unit after the concrete has solidified, by disconnecting the first and second fasteners from the first and second securement plates, respectively, to enable removal of the first sidewall and the first and second spacers.

7. The concrete form of claim 6, wherein the first and second fasteners are configured to be disconnected from the first and second securement plates by partially withdrawing the first and second fasteners such that the first and second fasteners are disconnected from the first and second securement plates and still connect the first sidewall to the first and second spacers to permit removal of the first sidewall and the first and second spacers as the single unit.

8. The concrete form of claim 1, wherein the first and second spacers each comprise a dowel portion projecting outwardly from the first side thereof, and wherein the dowel portions of the first and second spacers are received in first and second holes in the first sidewall, wherein the first side of each of the first and second spacers is wider than the dowel portion thereof, and wherein the dowel portions of the first and second spacers have a plurality of radial ribs extending outward and engaging inner surfaces of the first and second holes to retain the first and second spacers in the first and second holes.

9. The concrete form of claim 1, further comprising:

a plurality of additional cross ties each having opposed first and second ends, wherein the first sidewall is removably secured to the first end of each of the additional cross ties and the second sidewall is secured to the second end of each of the additional cross ties; and a plurality of additional spacers each positioned between the first sidewall and the first end of one of the additional cross ties to define spaces between the first sidewall and the additional cross ties, wherein the additional spacers are connected to the first sidewall and removably connected to the first ends of the additional cross ties, and wherein the additional spacers are connected to the first sidewall such that the additional spacers are also removed with the first sidewall and the first and second spacers as a single unit.

10. The concrete form of claim 1, wherein the concrete form is a prefabricated concrete form.

11. The concrete form of claim 1, wherein the first sidewall is a removable sidewall having a first thickness and a first height, and the second sidewall is an insulating sidewall having a second thickness that is greater than the first thickness and a second height that is equal to the first height, wherein the second sidewall has complementary mating teeth and recesses on top and bottom surfaces thereof for stacking, and wherein the first sidewall is dimensioned so that the first thickness is no larger than a distance defined between the teeth and the inner surface of the second sidewall.

12. A concrete form comprising:

a first sidewall and a second sidewall positioned in parallel and spaced relation to each other to define a cavity, with inner surfaces of the first and second sidewalls facing the cavity;

a cross tie having opposed first and second ends and having a flat securement plate on the first end, wherein the first sidewall is removably secured to the first end of the cross tie by a removable fastener extending through the first sidewall and embedded in the securement plate, and the second sidewall is secured to the second end of the cross tie; and a spacer positioned between the first sidewall and the first end of the cross tie to define a space between the first sidewall and the cross tie, wherein the spacer is connected to the first sidewall and removably connected to the cross tie by the fastener, such that the fastener extends through the spacer, wherein the spacer has a first side engaging the inner surface of the first sidewall and a second side opposite the first side, the second side of the spacer engaging the securement plate, and wherein the securement plate has a larger area than the second side of the spacer, and wherein the concrete form is configured for use in forming a concrete structure within the cavity by introducing concrete into the cavity and allowing the concrete to solidify.

13. The concrete form of claim 12, wherein the second sidewall is an insulating sidewall that remains in place as insulation after the concrete structure is formed, and wherein the first sidewall has a first thickness, and the second sidewall has a second thickness that is greater than the first thickness.

14. The concrete form of claim 13, wherein the second sidewall includes complementary mating teeth and recesses on top and bottom surfaces thereof for stacking with identical insulating sidewalls, and wherein the first thickness of the first sidewall is dimensioned so that the first thickness is less than or equal to a distance between the teeth and the inner surface of the second sidewall.

15. The concrete form of claim 12, wherein the fastener is screwed directly into the securement plate to connect the fastener to the securement plate.

16. The concrete form of claim 12, wherein the spacer is connected to the first sidewall such that the first sidewall and the spacer are removeable as a single unit after the concrete has solidified, by disconnecting the fastener from the securement plate to enable removal of the first sidewall and the spacer.

17. The concrete form of claim 12, wherein the spacer comprises a dowel portion projecting outwardly from the first side thereof, and wherein the dowel portion is received in a hole in the first sidewall, wherein the first side of the spacer is wider than the dowel portion thereof, and wherein the dowel portion of the spacer has a plurality of radial ribs extending outward and engaging inner surfaces of the hole to retain the spacer in the hole.

18. The concrete form of claim 12, further comprising:

a plurality of additional cross ties each having opposed first and second ends, wherein the first sidewall is removably secured to the first end of each of the additional cross ties and the second sidewall is secured to the second end of each of the additional cross ties; and a plurality of additional spacers each positioned between the first sidewall and the first end of one of the additional cross ties to define spaces between the first sidewall and the additional cross ties, wherein the additional spacers are connected to the first sidewall and removably connected to the first ends of the additional cross ties, and wherein the additional spacers are connected to the first sidewall such that the additional spacers are also removed with the first sidewall and the spacer as a single unit.

19. The concrete form of claim 12, wherein the first sidewall is a removable sidewall having a first thickness and a first height, and the second sidewall is an insulating sidewall having a second thickness that is greater than the first thickness and a second height that is equal to the first height, wherein the second sidewall has complementary mating teeth and recesses on top and bottom surfaces thereof for stacking, and wherein the first sidewall is dimensioned so that the first thickness is no larger than a distance defined between the teeth and the inner surface of the second sidewall.

20. An assembly comprising:

a first concrete form comprising:

a first sidewall and a second sidewall positioned in parallel and spaced relation to each other to define a first cavity, with inner surfaces of the first and second sidewalls facing the first cavity;

a first cross tie having opposed first and second ends and having a flat securement plate on the first end, wherein the first sidewall is removably secured to the first end of the first cross tie by a removable fastener extending through the first sidewall and embedded in the securement plate, and the second sidewall is secured to the second end of the first cross tie; and a spacer positioned between the first sidewall and the first end of the first cross tie to define a space between the first sidewall and the first cross tie, wherein the spacer is connected to the first sidewall and removably connected to the first cross tie by the fastener, such that the fastener extends through the spacer, wherein the spacer has a first side engaging the inner surface of the first sidewall and a second side opposite the first side, the second side of the spacer engaging the securement plate, and wherein the securement plate has a larger area than the second side of the spacer; and a second concrete form comprising:

a third sidewall and a fourth sidewall positioned in parallel and spaced relation to each other to define a second cavity, with inner surfaces of the third and fourth sidewalls facing the second cavity; and a second cross tie having opposed first and second ends, wherein the third sidewall is secured to the first end of the second cross tie, and the fourth sidewall is secured to the second end of the second cross tie, wherein the first concrete form is stacked upon the second concrete form such that the first and second cavities are continuous with each other, and wherein the assembly is configured for use in forming a concrete structure by introducing concrete into the first and second cavities and allowing the concrete to solidify.

* * * * *